US011667418B2

(12) United States Patent
Neeser et al.

(10) Patent No.: US 11,667,418 B2
(45) Date of Patent: Jun. 6, 2023

(54) STRAPPING APPARATUS

(71) Applicant: Signode Industrial Group LLC, Tampa, FL (US)

(72) Inventors: Mirco Neeser, Ehrendingen (CH); Dimitrios Takidis, Dübendorf (CH); Andreas Keller, Birr (CH)

(73) Assignee: Signode Industrial Group LLC, Tampa, FL (US)

( * ) Notice: Subject to any disclaimer, the term of this patent is extended or adjusted under 35 U.S.C. 154(b) by 0 days.

(21) Appl. No.: 18/151,259

(22) Filed: Jan. 6, 2023

(65) Prior Publication Data

US 2023/0147635 A1 May 11, 2023

Related U.S. Application Data

(63) Continuation of application No. 17/446,049, filed on Aug. 26, 2021, now Pat. No. 11,560,246, which is a (Continued)

(30) Foreign Application Priority Data

Sep. 18, 2016 (CH) ..... 01213/16

(51) Int. Cl.
*B65B 13/22* (2006.01)
*B65B 13/18* (2006.01)
(Continued)

(52) U.S. Cl.
CPC ..... *B65B 13/322* (2013.01); *B65B 13/185* (2013.01); *B65B 13/22* (2013.01); *B65B 13/327* (2013.01); *B65B 65/02* (2013.01)

(58) Field of Classification Search
CPC ..... B65B 13/00; B65B 13/02; B65B 13/025; B65B 13/185; B65B 13/187; B65B 13/22; B65B 13/322; B65B 13/327; B65B 65/02
(Continued)

(56) References Cited

U.S. PATENT DOCUMENTS 2,007,002 A 7/1935 Porter
3,206,167 A 9/1965 Armington
(Continued)

FOREIGN PATENT DOCUMENTS

CN 2346694 Y 11/1999
CN 1297270 A 5/2001
(Continued)

OTHER PUBLICATIONS

"CB130 Operating Instructions—Hand Tool", Cyklop, available before the priority date of the present application.
(Continued)

*Primary Examiner* — Stephen F. Gerrity
(74) *Attorney, Agent, or Firm* — Neal, Gerber & Eisenberg LLP

(57) ABSTRACT

A strapping apparatus for strapping articles with a strapping band having a tensioning device for imparting a band tension to a loop of the strapping band, the tensioning device including a driveable tensioning element provided for engaging the strapping band to impart a band tension. The strapping apparatus including a connecting device for generating a permanent connection, in particular a welded connection, at two regions, situated one above the other, of the loop of the strapping band. The strapping apparatus is configured to achieve the release of the tensioning element from the strapping band reliably to avoid or reduce adverse characteristics attributed to the release of the tensioning device from the band.

29 Claims, 22 Drawing Sheets

Related U.S. Application Data continuation of application No. 16/331,002, filed as application No. PCT/US2017/050473 on Sep. 7, 2017, now Pat. No. 11,104,460.

(51) Int. Cl.
*B65B 13/32* (2006.01)
*B65B 65/02* (2006.01)

(58) Field of Classification Search
USPC ..... 53/580, 582, 588, 592; 100/29, 32, 100/33 PB; 140/93.2; 254/216
See application file for complete search history.

(56) References Cited

U.S. PATENT DOCUMENTS

| | | | | |
|---|---|---|---|---|
| 3,284,049 | A | 11/1966 | Haraden | |
| 3,360,017 | A | 12/1967 | Vilcins | |
| 3,442,733 | A | 5/1969 | Vilcins | |
| 3,583,315 | A | 6/1971 | Hebert | |
| 3,792,808 | A | 2/1974 | Neff et al. | |
| 3,844,317 | A | 10/1974 | Angarola et al. | |
| 4,020,879 | A | 5/1977 | Billett et al. | |
| 4,239,096 | A | 12/1980 | Smilgys et al. | |
| 4,313,779 | A | 2/1982 | Nix | |
| 4,450,032 | A | 5/1984 | Wehr | |
| 4,607,709 | A | 8/1986 | Walser | |
| 4,718,522 | A | 1/1988 | Frania et al. | |
| 5,632,851 | A | 5/1997 | Young | |
| 5,653,095 | A | 8/1997 | Stamm | |
| 5,881,855 | A | 3/1999 | Putney et al. | |
| 5,916,108 | A | 6/1999 | Drietz et al. | |
| 6,206,053 | B1 * | 3/2001 | Hillegonds | B65B 13/027 140/93.2 |
| 6,328,087 | B1 | 12/2001 | Finzo et al. | |
| 6,415,712 | B1 | 7/2002 | Helland et al. | |
| 6,578,337 | B2 | 6/2003 | Scholl et al. | |
| 7,857,560 | B2 | 12/2010 | Leggett et al. | |
| 8,567,310 | B2 | 10/2013 | Yi | |
| 9,284,080 | B2 | 3/2016 | Neeser et al. | |
| 9,346,572 | B2 | 5/2016 | Leppert | |
| 9,403,609 | B2 | 8/2016 | Bonifazi et al. | |
| 9,586,708 | B2 * | 3/2017 | Finzo | B65B 13/185 |
| 9,630,730 | B2 | 4/2017 | Leppert | |
| 11,560,246 | B2 * | 1/2023 | Neeser et al. | B65B 13/322 |
| 2002/0179175 | A1 * | 12/2002 | Finzo | B65B 13/305 140/93.2 |
| 2003/0230058 | A1 | 12/2003 | Nix | |
| 2008/0219745 | A1 | 9/2008 | Bungert et al. | |
| 2010/0077810 | A1 * | 4/2010 | De Franceschi | G01G 15/00 70/283.1 |
| 2011/0056391 | A1 | 3/2011 | Neeser et al. | |
| 2011/0100233 | A1 | 5/2011 | Neeser et al. | |
| 2014/0083311 | A1 | 3/2014 | Bonifazi et al. | |
| 2014/0290179 | A1 | 10/2014 | Keller | |
| 2015/0033959 | A1 | 2/2015 | Finzo | |
| 2015/0034206 | A1 | 2/2015 | Finzo | |
| 2015/0210411 | A1 | 7/2015 | Finzo et al. | |
| 2015/0246739 | A1 | 9/2015 | Finzo et al. | |
| 2016/0107775 | A1 | 4/2016 | Amacker et al. | |

FOREIGN PATENT DOCUMENTS

| | | | | |
|---|---|---|---|---|
| CN | 1386675 | A | 12/2002 | |
| CN | 1386676 | A | 12/2002 | |
| CN | 201411059 | Y | 2/2010 | |
| CN | 105358432 | A | 2/2016 | |
| DE | 1973947 | U | 11/1967 | |
| DE | 3525647 | A1 | 1/1987 | |
| DE | 10026200 | A1 | 11/2001 | |
| EP | 0664256 | A1 | 7/1995 | |
| EP | 1260441 | A1 * | 11/2002 | B65B 13/22 |
| GB | 2098163 | A | 11/1982 | |
| GB | 2185229 | A | 7/1987 | |
| GB | 2185228 | B | 12/1987 | |
| JP | 01006555 | A | 1/1989 | |
| JP | 2004018117 | A | 1/2004 | |
| KR | 100943256 | B1 | 2/2010 | |
| WO | 2009129634 | A1 | 10/2009 | |
| WO | 2009129636 | A1 | 10/2009 | |

OTHER PUBLICATIONS

"Communication pursuant to Article 94(3) EPC", cited in corresponding European Patent Application No. 17 772 523.1 (5 pages), dated Dec. 23, 2020.

"Communication pursuant to Article 94(3) EPC", cited in corresponding European Patent Application No. 17 772 523.1 (5 pages), dated May 7, 2020.

"Description of the Operating Sequence of the Cyklop CB 130 Tool", The Cyklop CB 130 Tool was publicly available before the priority date of the present application.

"Docket Report", in U.S. District Court for the District of Delaware, Case No. 1:22-cv-00519, *Signode Industrial Group LLC* v. *Polychem, LLC*, Aug. 26, 2022.

"International Search Report and Written Opinion", PCT/US2017/050473 (11 pages), dated Dec. 8, 2017.

"Machine translation of Office Action", issued by Japan Patent Office in connection with JP2019-513774, dated Oct. 6, 2020.

"Office Action", From Corresponding Japanese Application No. JP2019-513774, Machine Translation, dated Feb. 25, 2020.

"Office Action", Related patent application JP 2019-513774, dated Feb. 25, 2020.

"Office Action", From corresponding Chinese Patent Application No. CN 201780055333.6, Machine Translation, dated Jul. 3, 2020.

"Office Action", KIPO corresponding patent application in KR Application No. 10-2019-7006727, dated Jul. 31, 2020.

"ORT-200 Manual Battery-hand Tool for Plastic Strapping", Orgapack, available before the priority date of the present application.

"ORT-250 Manual Battery-operated Hand Tool for Plastic Strapping", Orgapack, available before the priority date of the present application.

"Polychem, LLC's Answer to Complaint for Patent Infringement, Affirmative Defenses and Counterclaims", in U.S. District Court for the District of Delaware, Case No. 1:22-cv-00519, *Signode Industrial Group LLC* v. *Polychem, LLC*, Jun. 24, 2022.

"Signode Industrial Group LLC's Complaint for Patent Infringement", U.S. District Court for the District of Delaware, Case No. 1:22-cv-00519, *Signode Industrial Group LLC* v. *Polychem, LLC*, Apr. 22, 2022.

* cited by examiner

STRAPPING APPARATUS

PRIORITY CLAIM

This application is a continuation of, claims priority to and the benefit of U.S. patent application Ser. No. 17/446,049, filed on Aug. 26, 2021, which is a continuation of, claims priority to and the benefit of U.S. patent application Ser. No. 16/331,002, having a 371c date of Mar. 6, 2019, now U.S. Pat. No. 11,104,460, issued on Aug. 31, 2021, which is a national stage application of PCT/US2017/050473, filed on Sep. 7, 2017, which claims priority to and the benefit of Swiss Patent Application No. 01213/16, filed Sep. 18, 2016, the entire contents of each of which are incorporated herein by reference.

FIELD

The present disclosure relates to a strapping apparatus for strapping articles for packing with a strapping band, which strapping apparatus has a tensioning device for imparting a band tension to a loop of a strapping band, wherein the tensioning device is equipped with a tensioning wheel that can be driven in rotation about a tensioning axis and that is provided for engaging into the strapping band, the tensioning device furthermore has a tensioning plate, wherein, during a tensioning process performed by the tensioning device, it is provided that a single-layer or multi-layer section of the strapping band is situated between the tensioning wheel and the tensioning plate and is in contact both with the tensioning wheel and with the tensioning plate, and a connecting device for producing a permanent connection, in particular a welded connection, at two regions, situated one above the other, of the loop of the strapping band by way of a connecting element, such as a welding element, which is provided for locally heating the strapping band.

BACKGROUND

Strapping apparatuses of said type are used for strapping articles for packing with a plastics band. For this purpose, a loop of the respective plastics band is placed around the article for packing. In general, the plastics band is in this case drawn off from a supply roll. After the loop has been placed all the way around the article for packing, the end region of the band overlaps a section of the band loop. The strapping apparatus is then applied to said two-layer region of the band, and here, the band is clamped in the strapping apparatus, a band tension is imparted to the band loop by way of the tensioning device, and a fastening is produced by friction welding on the loop between the two band layers. Here, pressure is exerted on the band by way of a friction shoe that moves in oscillating fashion in the region of two ends of the band loop. The pressure and the heat generated by the movement causes the band, which is generally of plastic, to locally melt for a short period of time. This gives rise between the two band layers to a permanent connection, which can be released again at most with high force, between the two band layers. Thereafter, or approximately at the same time, the loop is severed from the supply roll. The respective article for packing has thereby been strapped.

Generic strapping apparatuses are provided for mobile use, wherein the appliances are intended to be carried by a user to the respective usage location and, there, should not be dependent on the use of externally supplied energy. In the case of known strapping appliances, the energy required for the intended use of such strapping appliances for tensioning a strapping band around articles for packing of any type and for producing a fastening is generally provided by an electric battery or by compressed air. By way of said energy, the band tension introduced into the band by way of the clamping device is generated, and a fastening is produced on the strapping band. Generic strapping apparatuses are furthermore provided for connecting only weldable plastic bands to one another.

After a tensioning process has been performed and after a fastening has been formed, the band must be removed from the strapping apparatus again. Here, the problem exists that the tensioning device must release the band which has been loaded with a high band tension. The band tension acts on the tensioning device as a force or torque directed oppositely to the drive direction of the tensioning device. A release of the tensioning device from the band by way of known freewheels provided for this purpose therefore has the result that the tensioning device is relieved of load abruptly. Such an abrupt release firstly constitutes a high dynamic load on the fastening between the two band layers of the strap, which fastening has just been manufactured and has possibly not yet fully cooled down and thus does not yet exhibit its maximum load-bearing capability. Secondly, the abrupt release also acts as a high dynamic load on the tensioning device of the strapping apparatus, which, in particular after a high number of strapping cycles, can lead to damage and wear and to adjustment of presets. Finally, the tensile stress of the band, which acts on the tensioning wheel and on the tensioning plate, can lead to jamming of the rocker that is provided in many known portable strapping devices and on which either the tensioning plate or the tensioning wheel are pivotably arranged. Such jamming can have the effect that the tensioning wheel and the tensioning rocker can no longer be lifted off from the band.

SUMMARY

The present disclosure is therefore based on the object of improving generic, in particular mobile, strapping apparatuses of the type mentioned in the introduction with regard to their functional reliability, such that the release of the strapping band can be realized reliably and adverse characteristics attributed to the release of the tensioning device from the band are avoided, or at least reduced.

According to the present disclosure, said object is achieved in the case of a strapping apparatus of the type mentioned in the introduction by way of the features described herein. Thus, in the case of a strapping apparatus as per certain embodiments the mechanism of a freewheel for releasing the tensioning element from the strapping band may be provided, which, during an actuation, with at least initial slippage, eliminates an operative connection between a drive of the tensioning element and the tensioning element, and, as a result of the restoring movement of said mechanism, generate the operative connection again. By way of the slippage or some other type of non-abrupt release of the tensioning element from its drive or from a locking mechanism, the mechanism of the strapping device is less highly loaded, and the mechanism can be relieved of tension gently.

The present disclosure may in particular, and preferably, comprise a freewheel which is provided with a wrap spring and that serves for releasing the tensioning wheel from a torque-absorbing support of the tensioning wheel on an immovable element of the strapping apparatus, such as for example the base plate. Furthermore, the present disclosure may be equipped with a mechanism for actuating the wrap spring in order to eliminate and generate frictional engagement of the wrap spring with at least one contact partner.

According to the present disclosure, it may thus be provided that a wrap spring as a constituent part of a freewheel is arranged in the region of a torque-supporting bearing arrangement of the tensioning device, which wrap spring connects a bearing arrangement of the tensioning wheel rotationally conjointly to the base plate for the execution of the tensioning process. After a tensioning process has been performed, the wrap spring and thus the freewheel may be actuable in order to temporarily release the torque-supporting bearing arrangement, such that the tensioning wheel or some other tensioning element is rotatable freely relative to the band without drive. The tensioning wheel can thus be released from the band with little expenditure of force, and the drive train of the tensioning wheel can hereby be relieved of tension.

By way of the wrap spring, it is possible here to realize a gradual—rather than an abrupt—release of the connection that is fixed in terms of torque. Proceeding from a slip-free, frictionally engaging, rotationally conjoint connection of the wrap spring to its at least one contact partner, the wrap spring, when actuated, initially permits slippage before the frictionally engaging connection is fully eliminated and the wrap spring and its contact partner are freely rotatable relative to one another. Both for the band from which the tensioning wheel is to be lifted off, and for the tensioning device, it is thus possible, owing to the avoidance of abrupt changes in load, for the release of the strapping band from the strapping apparatus to be performed in a more material-conserving manner.

In a preferred embodiment of the present disclosure, the wrap spring may have at least one, and preferably two, contact partners. One of the contact partners is in this case connected rotationally conjointly to the tensioning wheel, whereas the optional other contact partner should be connected rotationally conjointly to a positionally fixed component such as a carrier of the strapping apparatus. A frictionally engaging connection to both contact partners should exist during the tensioning process, such that the tensioning wheel can be supported by way of the wrap spring and its two contact partners in order to exert the torque, which is provided by a drive of the tensioning device, on the band on the positionally fixed component, for example a base plate. With at least one of the two contact partners, it may be possible for the frictionally engaging connection to be eliminated by actuation of the wrap spring and to subsequently be generated again by way of a restoring movement. The second contact partner may in particular also be provided for ensuring the dimensional stability of the wrap spring and for preventing a change in position of the wrap spring during the actuation thereof.

The at least one contact partner, preferably both of the contact partners that are provided, may each be in the form of a cylindrical element, wherein the two contact partners should preferably be arranged within the wrap spring. With inner sides of their windings, the wrap springs can generate the frictional engagement with outer circumferential surfaces of the preferably cylindrical contact partners. The wrap spring is, for this purpose, arranged under preload on the contact partners. In other embodiments according to the present disclosure, it is also possible to utilize outer sides of the windings for generating frictional engagement, wherein said outer sides should then come to bear against inner sides of hollow cylindrical contact partners.

In particularly preferred refinements of the present disclosure, the freewheel may be equipped with a rotatable toothing mechanism to which the wrap spring is connected by way of one of its ends, wherein the toothing mechanism is provided for engaging with one of the actuation mechanisms. Here, it may particularly expediently be provided that the toothing mechanism is a cylindrical element which is formed substantially coaxially with respect to the longitudinal axis of the wrap spring and which, in the region of its outer circumference, is equipped with a toothing, in particular with a toothing which runs around the full circumference or over part of the circumference. It may furthermore be expedient for one actuation mechanism to have a pivotable, circular-arc-shaped toothing element which, on its circular-arc-shaped circumferential region, is equipped with a toothing for engaging into the toothing of the cylindrical element. In these preferred embodiments of the present disclosure, for the actuation of the freewheel, it is thus provided that a rotational movement is transmitted to one of the ends of the wrap spring by way of engagement of intermeshing gearwheels. In this way, a particularly functionally reliable and reproducible actuation of the wrap spring can be made possible.

It should advantageously be provided here that, during the actuation of the freewheel, the preferably circular-arc-shaped toothing element enters into engagement with the toothing of the cylindrical element only when the freewheel is also to be switched and thus the tensioning wheel is to be released from its support on the strapping apparatus. It should likewise advantageously be provided that, during the automatic turning-back of the wrap spring, and thus during the restoration of the frictionally engaging connection, the circular-arc-shaped toothing element passes out of engagement with the toothing of the cylindrical element arranged on the wrap spring before the frictional engagement is generated again. In particular, by way of the latter measure, it can be ensured that, by way of the spring force of the wrap spring, complete abutment of the windings against their at least one contact partner is achieved, specifically even if, for this purpose, the end of the wrap spring assumes a different rotational position than was the case in its initial position before the actuation of the freewheel. In particular, owing to possible frictionally induced wear to the inner side of the wrap spring, it may be necessary after a multiplicity of actuations have been performed for the wrap spring to automatically turn back ever further beyond the original end position of the wrap spring end in order to generate the frictional engagement that is desired according to the present disclosure. Since the sleeve with its toothing should, at least toward the end of its turning-back movement, no longer be in engagement with the toothing element, and is thus freely rotatable, the turning-back can, in the described manner, be performed into new end positions every time, which end positions are dependent on the state of wear of the wrap spring and possibly also of its at least one contact partner. This embodiment of the present disclosure thus includes self-adjusting wear compensation of the freewheel. In conjunction with such a preferred embodiment of the present disclosure, it is in particular not necessary for readjustments to be repeatedly performed as maintenance work on the strapping apparatus owing to wear. Such maintenance work may then be necessary at most when the wrap spring has been worn to such an extent that sufficient frictional engagement is no longer realized, and thus the wrap spring must be exchanged.

In the case of two intermeshing toothings being used for transmitting a rotational movement, a blockage may occur upon the initial engagement of the toothings because teeth strike one another by way of their tooth tips but the spacing of the two axes of rotation is smaller than the sum of the radii of the tip circles of the two toothings. The rotatability necessitates that each tooth engages in each case into the gap between two teeth of the rolling partner. If tooth tips strike one another, it is not possible for a rotational movement to be transmitted, and the gearing becomes blocked. Therefore, in a further preferred embodiment, the present present disclosure provides compensation mechanisms which, in the event of such mutual blockage of the toothings, preferably automatically eliminate said blockage. For this purpose, it may advantageously be provided that the forces that arise between the toothings owing to a blockage of the toothing elements are utilized in order to generate a torque of one of the two toothings about its axis of rotation and relative to the respective other toothing. This relative movement of one toothing results in a changed position of the mutually opposite teeth of the toothings, in particular such that, now, the first tooth of one toothing engages between two teeth of the other toothing, and the blockage is thus eliminated. It is preferable here for one of the two toothings to be turned back in relation to the direction of rotation that is actually intended. By way of this preferred refinement according to the present disclosure, it is thus possible for the functional reliability of the freewheel, which is equipped according to the present disclosure with a wrap spring, for releasing the operative connection between the tensioning wheel and the drive thereof, to be increased. Blockages of the toothing elements can thus be prevented or eliminated automatically and without the need for manual intervention by operating personnel.

In a preferred refinement of this embodiment of the present disclosure, it may be provided that a tooth, in particular a tooth which comes into contact first with the other rolling partner, of a toothing element is arranged on said toothing element in a deflectable manner, in particular a resiliently elastically deflectable manner. With the restoring force, generated owing to the resiliently elastic deflection, of the deflected tooth, a force can be exerted on the rolling partner, which force leads to a relative movement, in particular a rotational movement, of the rolling partner. In alternative embodiments, it may also be provided that, by way of the restoring force, the component on which the restoring force is generated itself performs a rotational movement relative to its rolling partner. Regardless of which component performs the relative movement, said movement may involve movements of small magnitude, which are however sufficient to change the rotational position of the in each case one toothing such that the first engagement tooth is arranged in the region between two teeth of the rolling partner, such that an engagement of said one tooth into the toothing of the rolling partner becomes possible.

In a particularly advantageous refinement of the above preferred exemplary embodiment, it may be provided that the restoring force acts on the rolling partner such that the direction of action of said restoring force runs with a spacing to the axis of rotation of the rolling partner. In this way, it is possible, with the restoring force, to generate a torque which acts about the axis of rotation of the rolling partner and which leads to an elimination of the blockage and to an orientation of the two toothings for correct engagement.

Further preferred refinements of the present disclosure will emerge from the claims, from the description and from the drawing.

BRIEF DESCRIPTION OF THE FIGURES

The present disclosure will be discussed in more detail on the basis of exemplary embodiments which are illustrated purely schematically in the figures, in which.

DETAILED DESCRIPTION

Figure 1:
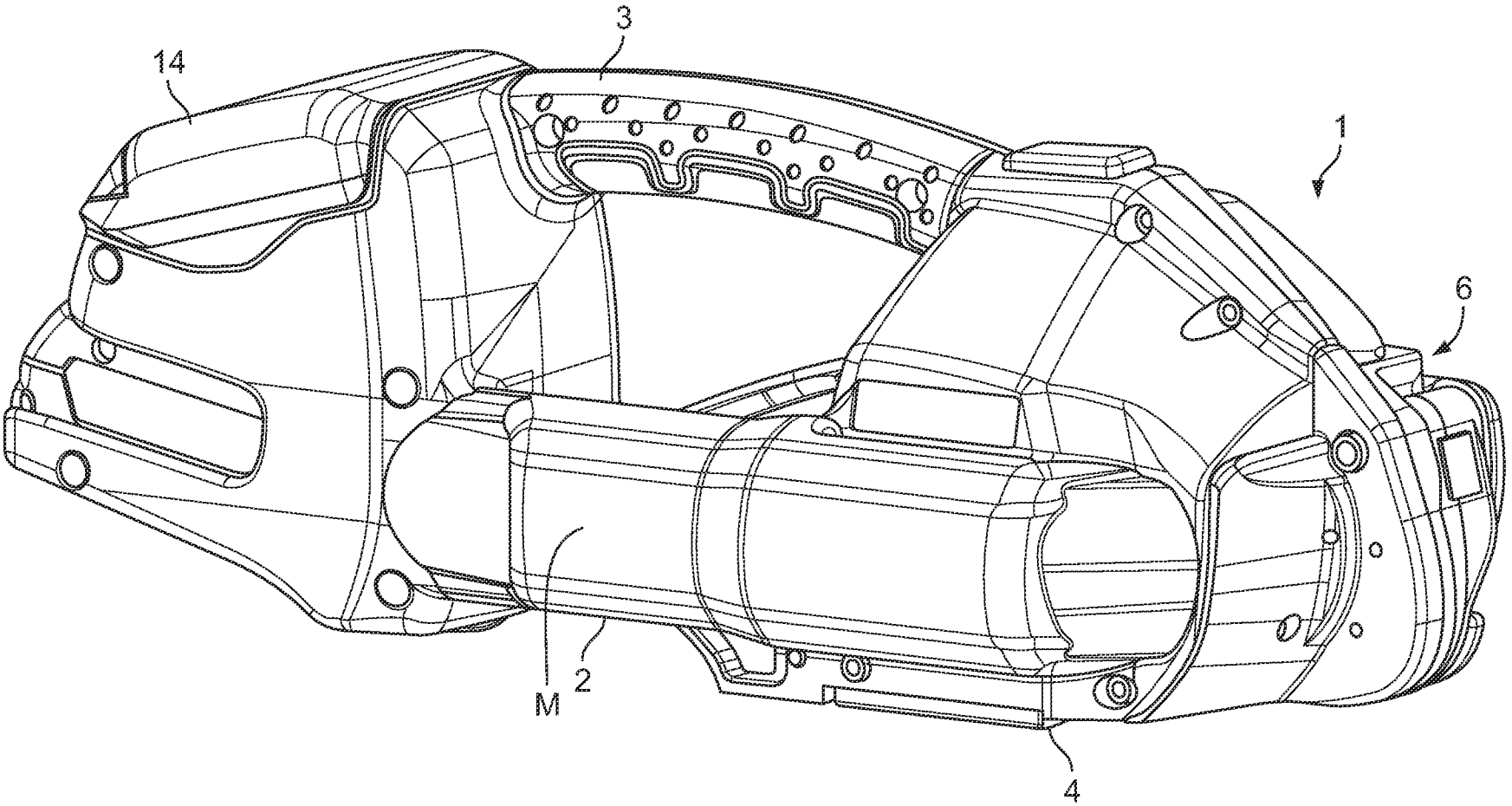
FIG. 1 shows a perspective illustration of a strapping appliance according to one example embodiment of the present disclosure.
Figure 1A:
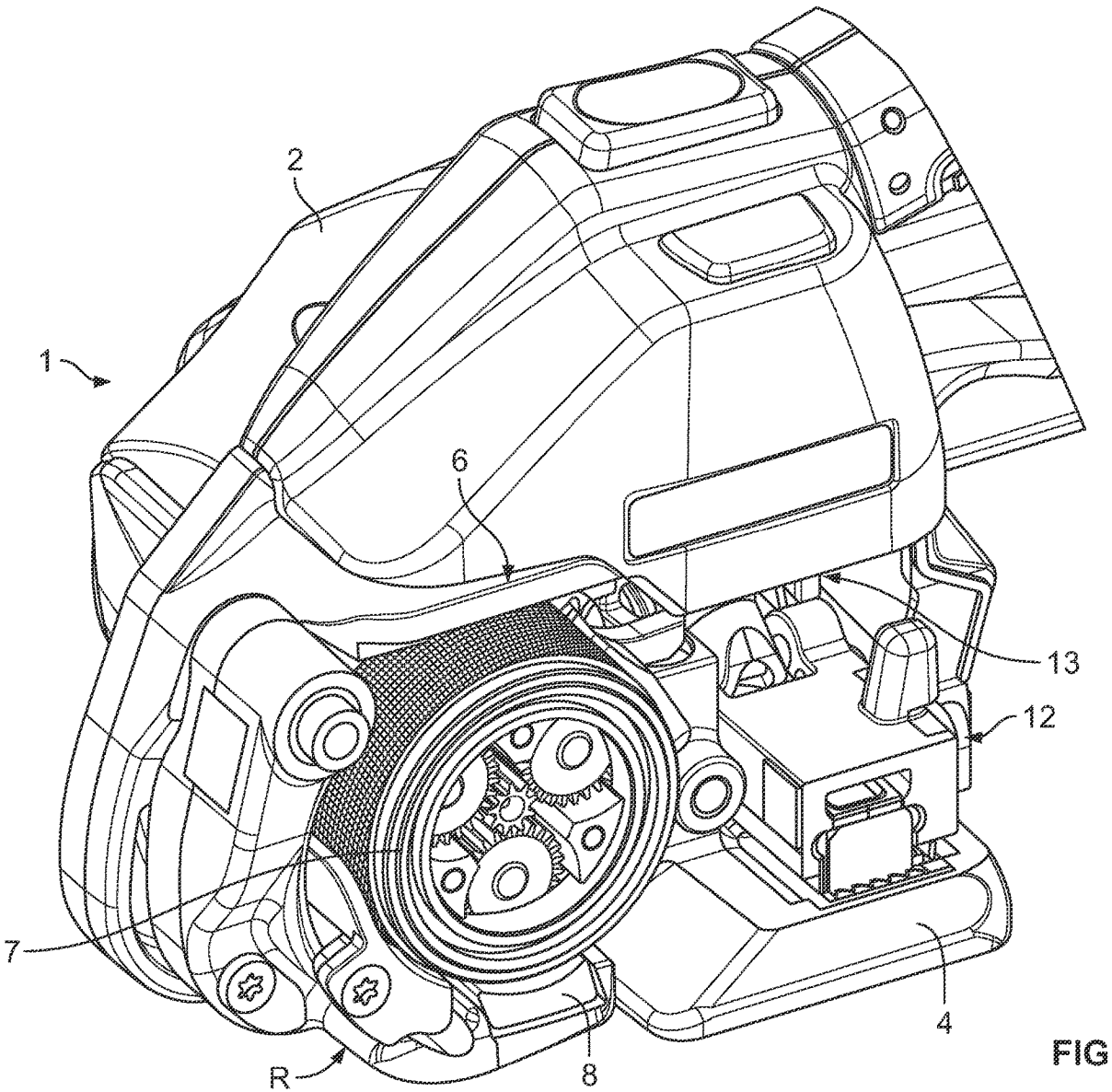
FIG. 1*a* shows a partial view of the strapping appliance from FIG. 1, in which a tensioning device and a connecting device of the strapping appliance can be seen.

While the systems, devices, and methods described herein may be embodied in various forms, the drawings show and the specification describes certain exemplary and non-limiting embodiments. Not all of the components shown in the drawings and described in the specification may be required, and certain implementations may include additional, different, or fewer components. Variations in the arrangement and type of the components; the shapes, sizes, and materials of the components; and the manners of connections of the components may be made without departing from the spirit or scope of the claims. Unless otherwise indicated, any directions referred to in the specification reflect the orientations of the components shown in the corresponding drawings and do not limit the scope of the present disclosure. This specification is intended to be taken as a whole and interpreted in accordance with the principles of the present disclosure and as understood by one of ordinary skill in the art.

Figure 2:
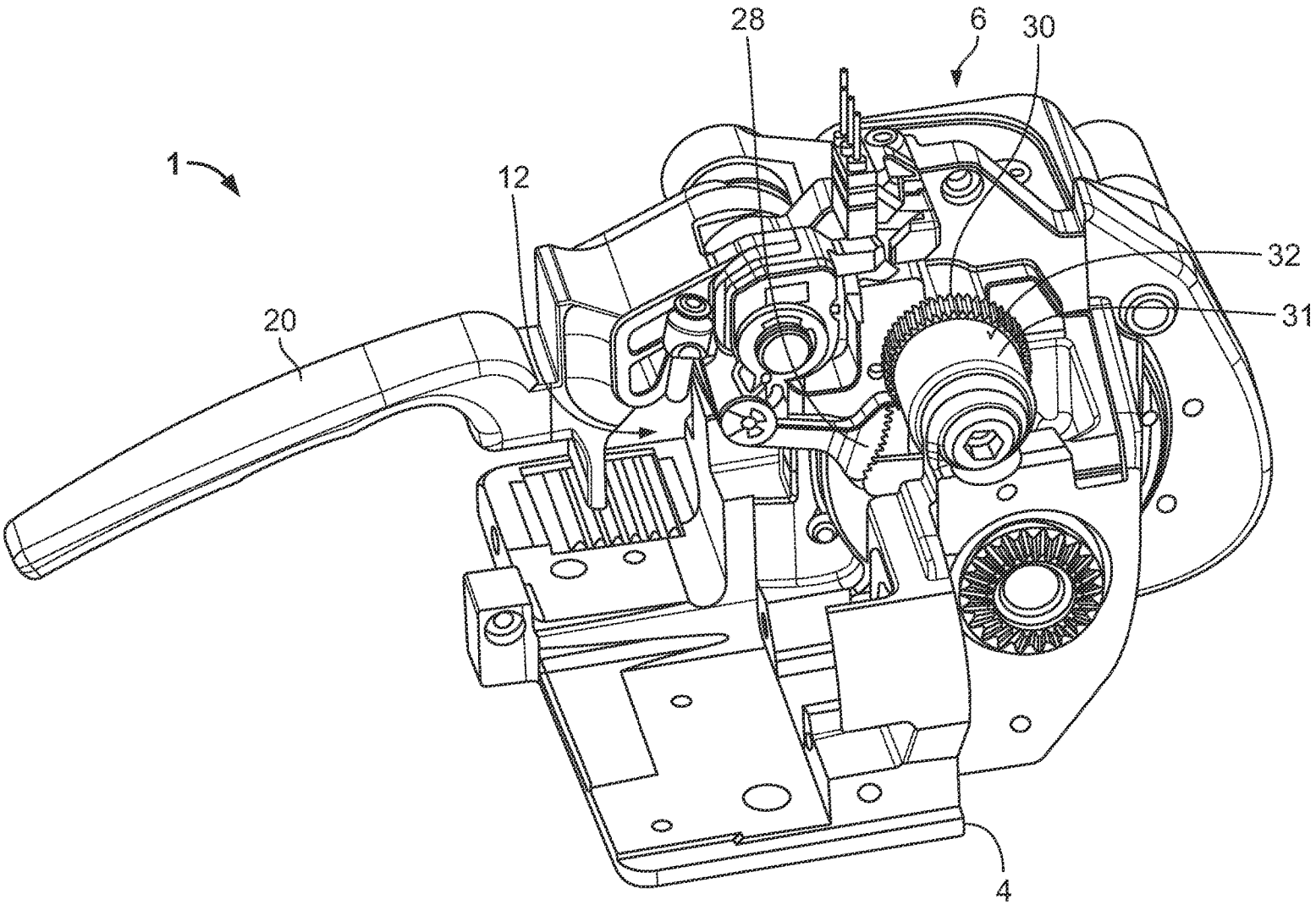
FIG. 2 shows a perspective partial illustration of the front region, which comprises the tensioning and wear device of the strapping appliance from FIG. 1, of said strapping appliance, with an actuation mechanism assuming a first end position.

The strapping appliance 1 shown in FIGS. 1 and 2 is used merely as an example for the present present disclosure. The description of the specific embodiment of the features of the strapping appliance 1 discussed below serves merely for the understanding of the present disclosure and does not represent a restriction to embodiments of the present disclosure which would imperatively have to have the features below.

The exclusively manually actuable strapping appliance 1 according to the first example embodiment of the present disclosure illustrated here merely by way of example has a housing 2 which surrounds the mechanism of the strapping apparatus and on which there is formed a handle 3 for the handling of the appliance. The strapping appliance is furthermore equipped with a base plate 4, the underside of which is provided for arrangement on an article to be packaged. All of the functional units of the strapping appliance 1 are fastened on the base plate 4 and on the carrier (not illustrated in any more detail) of the strapping appliance, said carrier being connected to the base plate.

By way of the strapping appliance 1, a loop (not illustrated in any more detail in FIG. 1) of a plastic band (not shown), composed for example of polypropylene (PP) or polyester (PET), which loop has, beforehand, been placed around the article to be packaged, can be tensioned by way of a tensioning device 6 of the strapping apparatus. In other embodiments of the present disclosure, it is also possible for bands composed of other materials, in particular of other plastics or of metallic materials, to be processed, wherein, in such embodiments, the respective strapping appliance may be adapted to the respectively provided band material. The tensioning device of the strapping appliance shown here has a tensioning wheel 7 (concealed by the housing in FIG. 1), tensioning mandrel or some other tensioning element of the tensioning device 6, by way of which the band can be gripped for a tensioning process. The tensioning wheel 7 interacts with a tensioning plate 8 such that the strapping band can, for tightening of the strapping band loop, be clamped between the tensioning wheel 7 and the tensioning plate 8, in particular while the tensioning wheel 7 is driven in rotation and, during said movement, by engaging into the strapping band and retracting the latter, applies said strapping band to the respective article to be packaged and imparts a band tension to the band of the band loop.

In the exemplary embodiment, the tensioning plate 8 is arranged on a pivotable rocker R (not illustrated in any more detail) which can be pivoted about a rocker pivot axis. The tensioning plate 8 can, by way of a pivoting movement of the rocker R about the rocker pivot axis, be transferred from an end position spaced apart from the tensioning wheel 7 into a second end position, in which the tensioning plate 8 is pressed against the tensioning wheel 7. By way of a corresponding motor-driven or manually driven movement in the opposite direction of rotation about the rocker pivot axis, the tensioning plate 8 can be moved away from the tensioning wheel 7 and pivoted back into its initial position, whereby the band situated between the tensioning wheel 7 and the tensioning plate is released for removal. In other preferred embodiments of the present disclosure, it is also possible for the tensioning wheel 7 to be arranged on the movable, in particular pivotable, rocker R and for the tensioning plate 8 to be arranged so as to be positionally fixed.

During the use of the illustrated embodiment of a tensioning apparatus, it is provided that two layers of the strapping band are situated between the tensioning wheel 7 and the tensioning plate, and are pressed against the tensioning plate by the tensioning wheel 7 or are pressed against the tensioning wheel 7 by the tensioning plate. By rotation of the tensioning wheel 7, it is then possible for the band loop to have imparted to it a band tension which is high enough for packaging purposes.

Subsequently, at a point of the band loop at which two layers of the band lie one above the other, welding of the two layers can be performed, in a manner known per se, by way of the friction welding and severing device 12 of the strapping appliance. The band loop can hereby be permanently closed. In the preferred exemplary embodiment shown here, the friction welding and severing device 12 can be driven by the same, only one motor M of the strapping appliance, by way of which all other motor-driven movements are also performed. For this purpose, in a manner known per se, in the transmission direction from the motor M to the points at which the motor-imparted drive movement, there is provided a freewheel (not illustrated in any more detail) which has the effect that the drive movement is transmitted in the drive direction of rotation, respectively provided for the purpose, to the corresponding functional unit of the strapping appliance, and no transmission takes place in the other drive direction of rotation, respectively provided for this purpose, of the motor M.

For this purpose, the friction welding device 12 is equipped with a welding shoe (not illustrated in any more detail) which is, by way of a transfer device 13, transferred from a rest position, with a spacing to the band, into a welding position, in which the welding shoe is pressed against the band. The welding shoe, which in this case is pressed against the strapping band by mechanical pressure, and the simultaneously performed oscillating movement of the welding shoe with a predetermined frequency, cause the two layers of the strapping band to melt. The locally plasticized or molten regions of the band flow into one another and, after the band cools, a connection between the two band layers then forms. If necessary, it is then possible for the band loop to be severed from a supply roll of the band by way of a cutting element (not illustrated in any more detail) of the friction welding and severing device 12 of the strapping appliance 1.

The advancement of the tensioning wheel 7 in the direction of the tensioning plate, the rotary drive of the tensioning wheel 7 about the tensioning axis, the opening of the rocker R with the tensioning wheel 7 or the tensioning plate, the advancement of the friction welding device 12 by way of the transfer device 13, and also the use of the friction welding device 12 per se, and the actuation of the severing device, are performed using only one common electric motor M, which provides a respective drive movement for these components of the strapping appliance. For the supply of electricity to the motor M, there is arranged on the strapping appliance an exchangeable battery 14, which can in particular be removed and exchanged for charging purposes, and which serves for storing electrical energy. A supply of other external auxiliary energy, such as for example compressed air or further electricity, may be provided, but is not provided in the case of the strapping appliance as per FIGS. 1 and 2. In other embodiments of the present disclosure, however, it is also possible for other forms of energy, in particular compressed air, to be utilized as drive energy instead of electrical energy.

On the drive shaft of the motor, behind the toothed belt drive to the welding device as viewed from the motor M, there is situated a bevel gear 16, which belongs to a bevel gear mechanism of the tensioning device 6, in the same way as a second bevel gear 17, with which the former bevel gear meshes. On the same shaft as that on which the second bevel gear 17 is arranged, there is also arranged a downstream gearing device (not illustrated in any more detail) by way of which the motor drive movement is utilized for driving the tensioning wheel. A gearing device of said type is included in the strapping appliance with the product designation OR-T 250 from Signode Industrial Group GmbH, Dietikon (Switzerland), and as described for example in WO 2009/129634 A1. The content of said document is hereby incorporated by reference.

The tensioning apparatus is furthermore equipped with a manually actuable hand lever 20, by way of the actuation of which a torque-absorbing support of the tensioning wheel on a cantilever 21 of the base plate 4 can be eliminated and, subsequently, the spacing between tensioning plate 8 and the tensioning wheel 7 can also be increased. This process is provided, after the tensioning of the band has been performed and after a fastening has been formed, in order to enable the tensioning wheel, which is now stationary and possibly braced with the band, to be released despite the band tension present in the band. This is a prerequisite in order that the band can be removed from the strapping appliance and, subsequently, in turn, strapping band can be inserted into the strapping appliance in order to form a new band loop.

The hand lever 20 is arranged on a shaft 22 and is pivotable about an axis of the shaft 22. On the same shaft there is also situated a circular-arc-shaped toothed segment 23 which is connected rotationally conjointly to the shaft 22 and which can be set in rotation by a rotational movement introduced by way of the hand lever 20. Arranged parallel to and with a spacing to the shaft 22, there is a further shaft 24, on which a lever element 25 is rotatably arranged. The lever element 25 is equipped, in the region of its bearing arrangement on the shaft 24, with a circular-arc-shaped toothing element 26 which meshes with the toothed segment 23 and can thus be set in rotation by a rotational movement of the toothed segment 23. On the lever element 25 there is formed a first lever arm 25*a* which projects substantially radially from the shaft 24. On a second lever arm 25*b* of the lever element 25, on the free end thereof, there is arranged a circular-arc-shaped toothing element 28. The toothing element 28 has only a small number of teeth 28*a*. A rotational movement of the lever arm 25 about the axis of its shaft 24 causes the toothing element 28 to perform a rotational movement along a circular segment about the axis of the shaft 24. The movement along the circular segment takes place here with a radius, wherein the toothing 28*a* of the toothing element 28 is formed along a circular arc with the same radius. The length of the circular arc of the toothing element 28 is shorter than the length of the circular arc segment along which the toothing element moves.

The toothing element 28 meshes with an external toothing 30 of a sleeve 31. Said external toothing 30 is formed along a complete circumferential line or a partial circumferential line of the outer shell surface 32 of the sleeve 31. The width of the external toothing 30 may in this case preferably be smaller than the length of the sleeve 31. The toothing element 28, during its movement along the circular arc segment, initially moves without engaging with the toothing 30 of the sleeve 31, and it is only on its path from its initial end position into its end position that said toothing element enters into engagement with the toothing 30 of the sleeve. As soon as the toothing element 28 and the sleeve 31 are in engagement with one another, the toothing element 28 rotates the sleeve 31 about its longitudinal axis.

Figure 6:
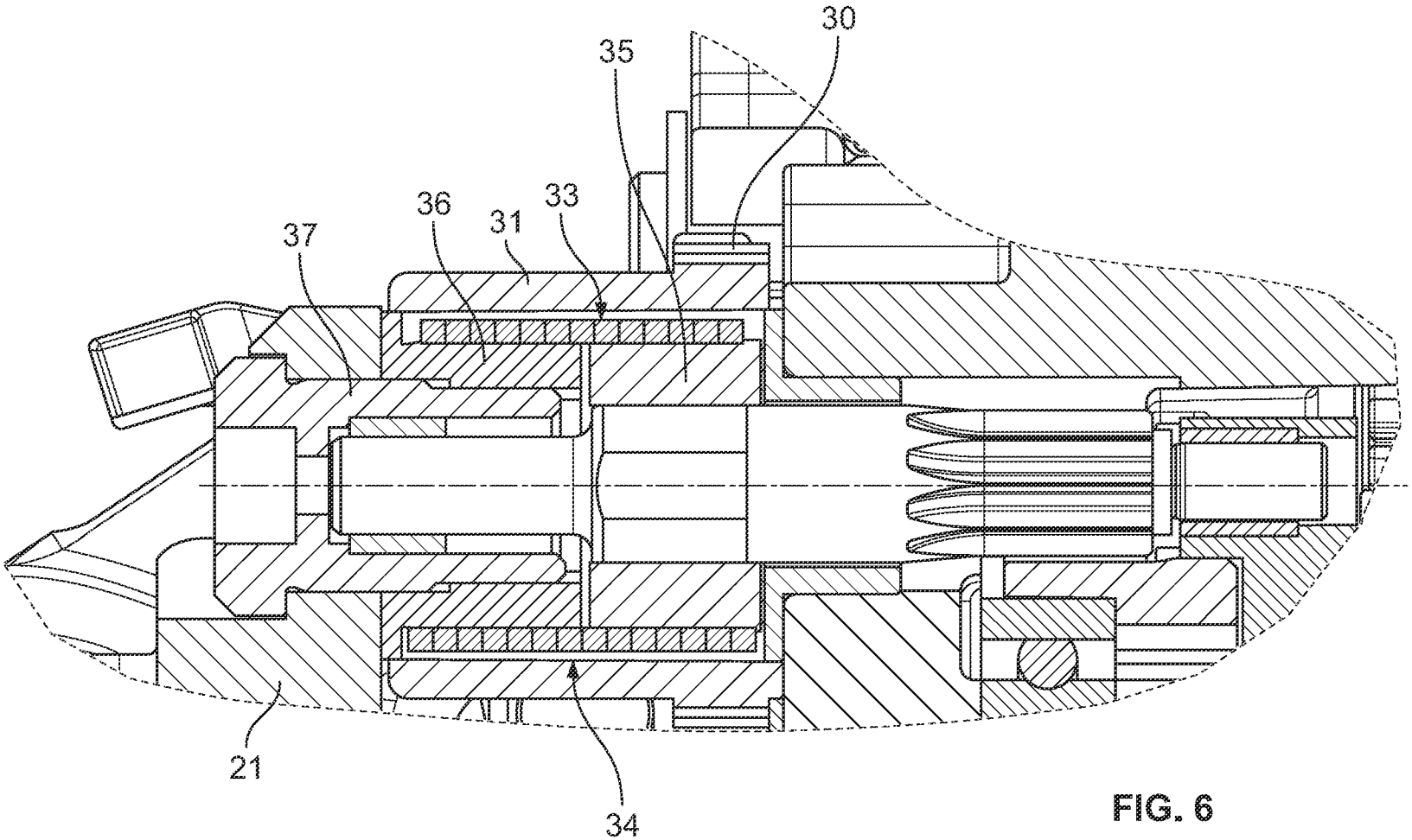
FIG. 6 shows a longitudinal section through a freewheel for a support mechanism of a tensioning wheel of the strapping appliance from FIG. 1.
Figure 7B:
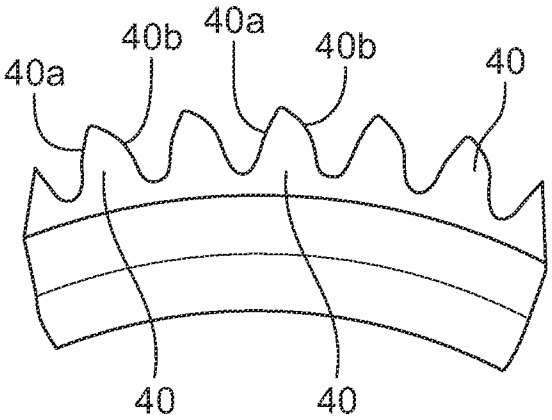
FIG. 7*b* shows a detailed illustration of the toothing of the sleeve-like element from FIG. 7*a;*
Figure 7A:
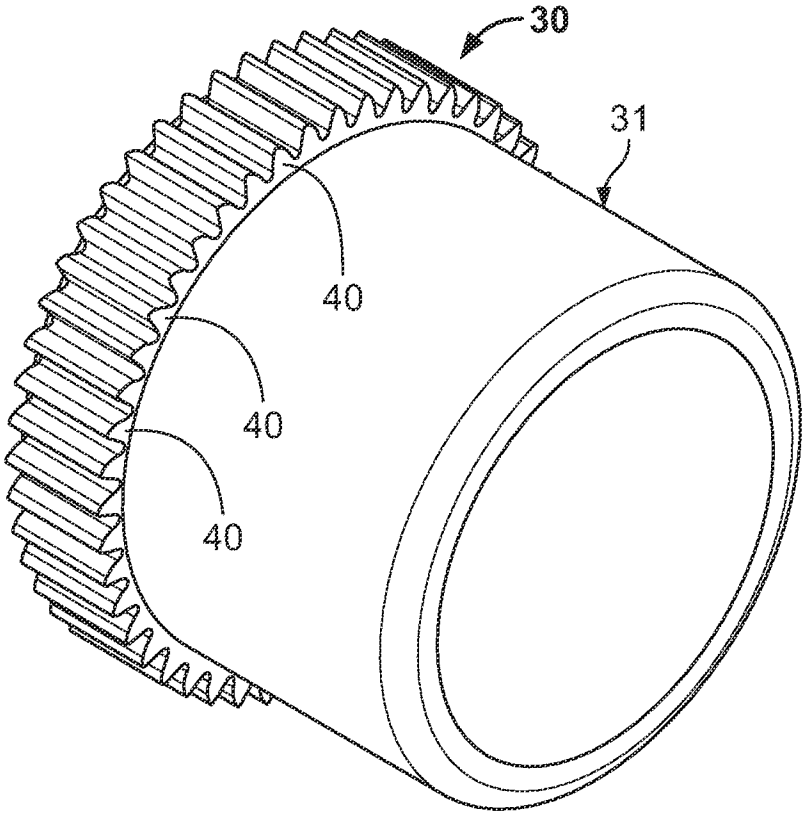
FIG. 7*a* shows a toothed sleeve-like element of the freewheel.

As per the illustration in FIG. 6, the sleeve 31 is arranged on a wrap spring 33 which, in the manner of a helical spring, has a multiplicity of windings. The windings have a small pitch and bear against one another. In the exemplary embodiment, the wrap spring 33 has at least 13 windings, and in other embodiments of the present disclosure, it is also possible for any other desired number of windings to be provided with which the wrap spring 33 can perform the function of a switching element, as will be discussed below.

A sleeve-like blocking roller 35 and a threaded bushing 36 are arranged coaxially within the wrap spring 33, which blocking roller and threaded bushing are situated one behind the other along the longitudinal axis and with in each case one of their face sides facing one another within the wrap spring 33. The wrap spring 33 can be actuated as a switching element of a freewheel 34 and, in its non-actuated state, bears with inner surfaces of its windings both against the blocking roller 35 and against the threaded bushing 36. In this way, a frictionally engaging and rotationally conjoint connection between the blocking roller 35 and the threaded bushing 36 is produced by way of the wrap spring 33. The threaded bushing 36 is screwed onto a bearing bolt 37, which in turn is arranged rotationally fixedly on the cantilever 21 of the base plate 4. Owing to this arrangement, the tensioning wheel 7 can, by way of the elements blocking roller 35 and threaded bushing 36 which are connected rotationally fixedly to one another by way of the wrap spring 33, be supported on the cantilever 21 of the base plate 4—and thus on the base plate 4 itself—during the tensioning process in order to exert the required torque on the strapping band.

The wrap spring 33 has in each case a first end region 33*a* (shown in FIG. 3) and a second end region (not shown) on each of its face ends. The second end region is fixed to the cantilever 21 of the base plate 4. The first end region 33*a* of the other face side of the wrap spring 33 is fastened to the sleeve 31. By way of a pivoting movement of the hand lever 20, it is thus possible, by way of the engagement of the toothed segment 23 into the toothing element 26 and of the circular-arc-shaped toothing element 28 into the toothing 30 of the sleeve 31, and the rotationally fixed arrangement of the second wrap spring end 33*b* on the cantilever 21, for the first end 33*a* of the wrap spring 33 to be actuated. Here, the circular-arc-shaped toothing element 28 performs a movement from the first end position shown in FIG. 4 into the second end position shown in FIG. 5.

Here, the actuation is performed substantially as a rotational or pivoting movement of the wrap spring end 33*a* about a longitudinal axis of the wrap spring 33 in a direction of rotation which causes at least some of the windings of the wrap spring 33 to increase in diameter. These are at least those windings of the wrap spring 33 which are arranged on the blocking roller 35 and which, in the non-actuated state of the wrap spring, produce a frictionally engaging connection with the blocking roller 35. As a result of the actuation of the wrap spring 33, said frictional engagement is entirely or partially eliminated. The elimination of the frictional engagement should occur at least to such an extent that the blocking roller 35 that is indirectly connected to the tensioning wheel 7 can rotate about its own longitudinal axis relative to the wrap spring 33. The elimination of the frictional engagement thus has the result that the tensioning wheel 7 can no longer hold the torque that is exerted back on the tensioning wheel 7 by the already-tensioned band owing to the band tension. In this state, the tensioning plate 8 can be pivoted away from and lifted off the tensioned band. In alternative preferred embodiments according to the present disclosure, in which the tensioning wheel 7 rather than the tensioning plate 8 is arranged pivotably on the rocker R, it is possible for the tensioning wheel 7 to be pivoted away for the purposes of generating a spacing between the tensioning wheel 7 and the tensioning plate. Regardless of whether the tensioning wheel 7 or the tensioning plate 8 is articulated in pivotable fashion, it is possible in various embodiments of the present disclosure, owing to the interruption of the operative connection between the tensioning wheel 7 and the motor, for the tensioning wheel to possibly also be automatically rotated backward counter to the original drive direction of the tensioning wheel before the pivoting movement. The tensioning wheel is thus released from the tensioned band, and the band can subsequently be removed from the strapping appliance 1.

Owing to the movement originating from the release of the tensioning wheel, in this case a pivoting movement, of the hand lever 20, the wrap spring 33 does not abruptly pass entirely out of engagement with its contact partner, the blocking roller 35. Owing to the rotational movement of the actuated wrap spring end 33*a*, a gradual widening of diameters of successive windings of the wrap spring occurs. In this way, slippage between the blocking roller 35 and the wrap spring 33 is generated that increases with a progression of the actuation movement of the hand lever 20. The increasing slippage simultaneously yields decreasing frictional engagement between the blocking roller 35 and the wrap spring 33. As a result, an abrupt release of the tensioning wheel 7 can be prevented, and a gradual release of the tensioning wheel 7 can be achieved. Both the band and the mechanism of the strapping apparatus 1 are thereby protected against abrupt unloading of the band and thus against a highly dynamic change in load.

It is basically possible for any desired toothings, which must however fit with one another, to be provided for the circular-arc-shaped toothed segment 23, the toothing element 26, the circular-arc-shaped toothing element 26 and for the external toothing 30 of the sleeve 31. Involute toothings in particular may be provided. In the preferred embodiment according to the present disclosure illustrated in the figures, an asymmetrical toothing is provided for the external toothing 30 of the sleeve 31, wherein all teeth 40 of the sleeve 31 have geometrically identically designed teeth 40. Said teeth 40 have, on one engagement side, a toothing flank 40*a* similar to a straight toothing and, on the other engagement side, a tooth flank 40*b* of similar design to an involute toothing, that is to say a tooth flank 40*b* which has a more pronounced curvature than its other toothing flank 40*a*. The tooth flanks 40*a*, 40*b* may taper to a point in the tip region of the tooth flanks, such that the risk of mutual striking of tooth tips of gearwheels which mesh with one another but which block one another is reduced. Here, the tooth flank 40*a* with the less pronounced curvature in each case should be arranged in a switching direction, that is to say in a direction of the rotational movement in which the release of the tensioning wheel is effected. During the switching process, the teeth of the toothing element 28 thus strike in each case that tooth flank 40*a* of the teeth 40 of the sleeve 31 which have the less pronounced curvature. This described basic tooth geometry is also configured for preventing blockage of gearwheels.

Figure 3:
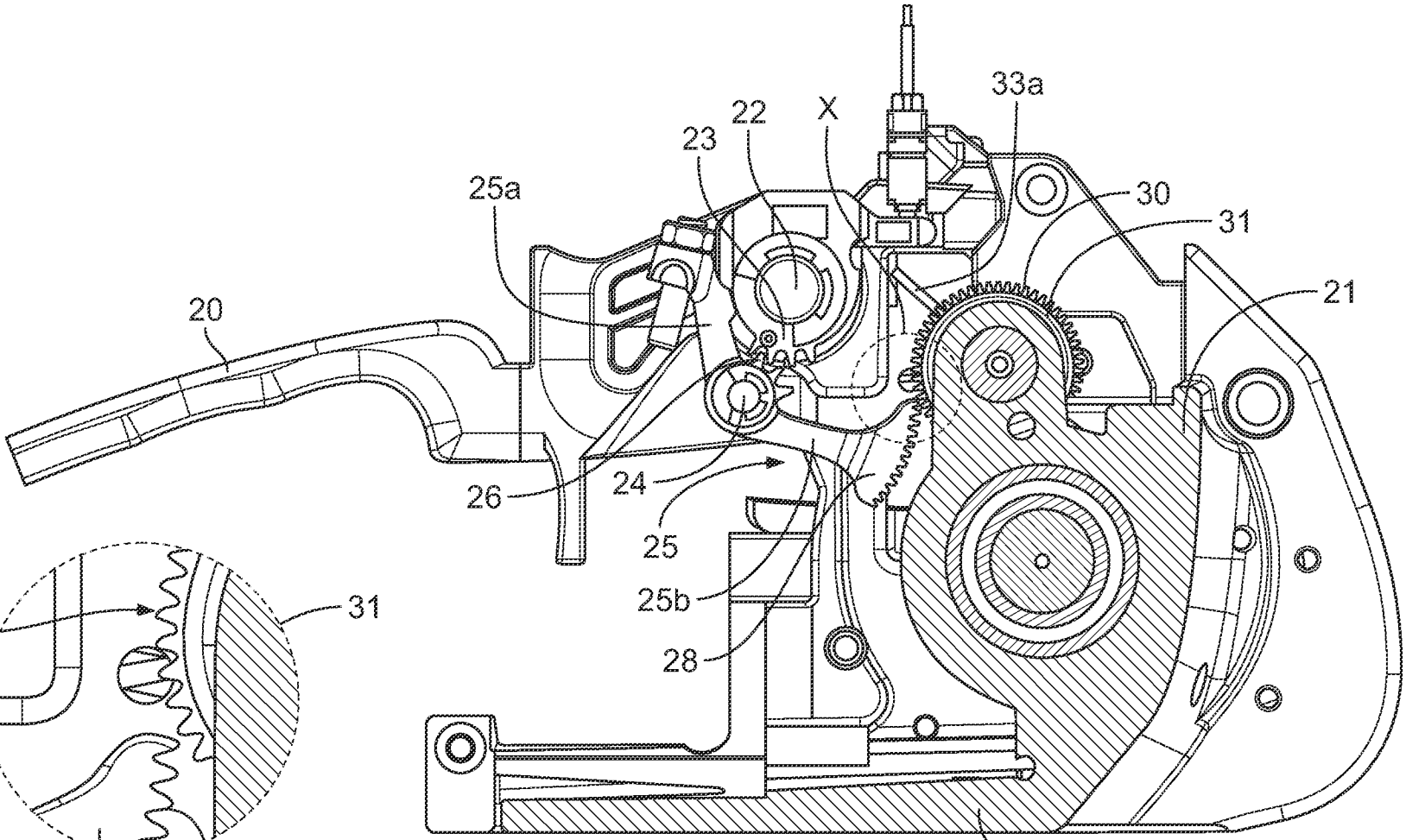
FIG. 3 shows a sectional illustration through a cantilever and the base plate of the strapping appliance from FIG. 1.
Figure 4:
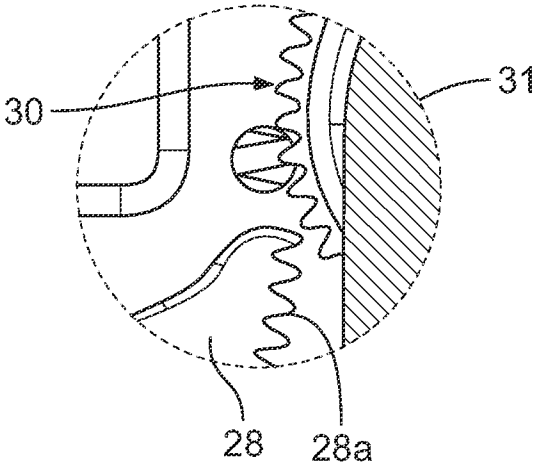
FIG. 4 shows a detail as per the line X from FIG. 3.
Figure 5:
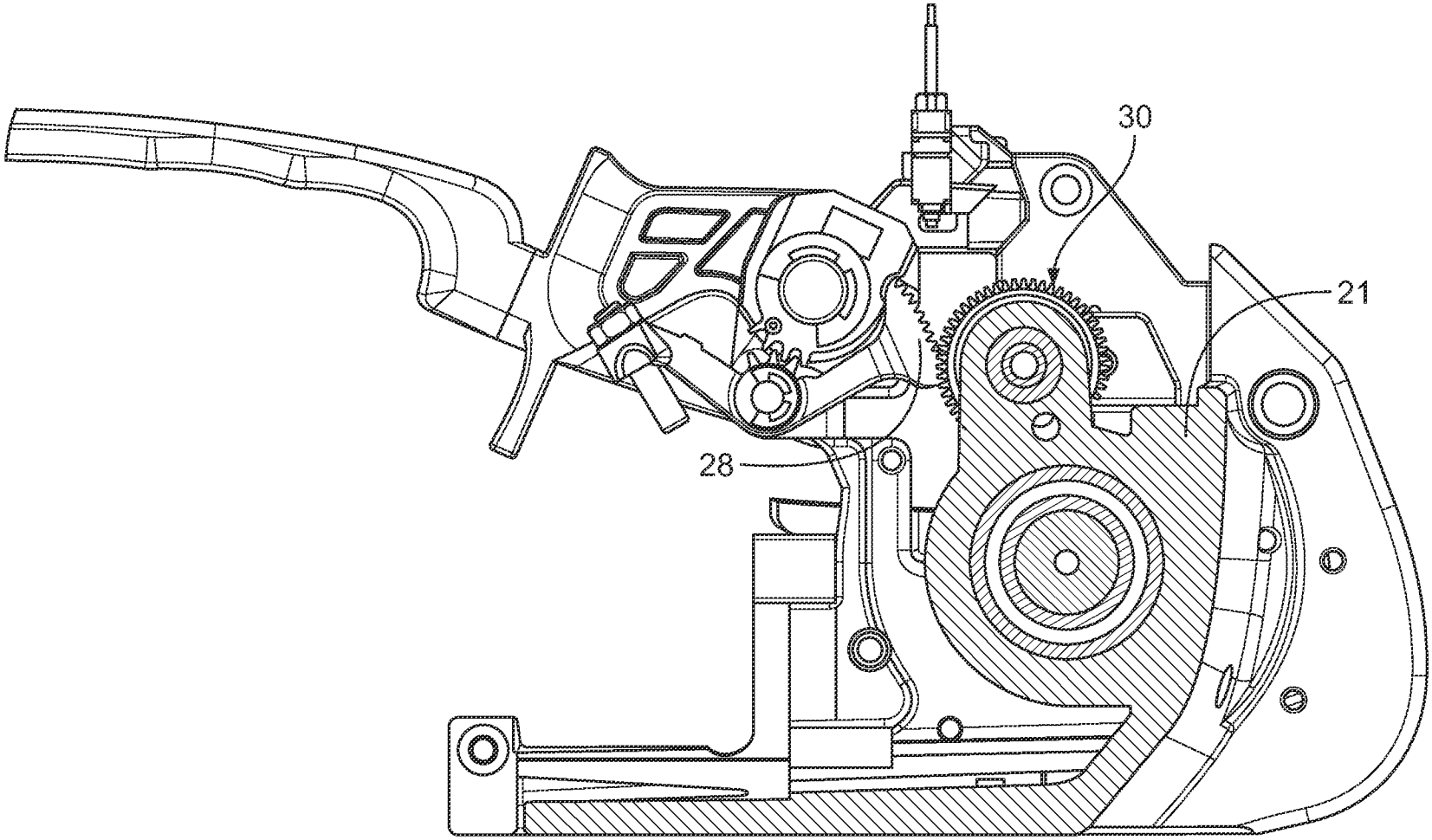
FIG. 5 shows an illustration as per FIG. 3 with an actuation mechanism in a second end position.

During the restoring movement of the wrap spring 33 owing to the restoring spring force built up during the switching process, it is then the case that the tooth flanks 40*b* with the more pronounced curvature come into contact, for transmitting movement, with the teeth 28*a* of the toothing element 28 and transmit the torque which is exerted by the sleeve 31 on the toothing element 28 owing to the spring restoring force. Both the sleeve 31, together with the end 33*a* of the wrap spring 33, and the lever element 25 then rotate backward in each case in the opposite direction of rotation. Likewise, the lever element 25, via the toothing element 26, pivots the hand lever 20 back into its initial position. The rotational movement of the lever element 25 occurs until the toothing element 28, during its rotational movement, passes out of engagement with the external toothing 30 of the sleeve 31. By contrast, the sleeve 31 rotates backward until the wrap spring 33 bears against the outer surface of the blocking roller 35 again and a further reduction in the diameter of the windings is no longer possible. In the drawing, this is shown in FIGS. 3 and 5, wherein FIG. 5 shows the initial position of the restoring movement and FIG. 4 shows the end position of the restoring movement.

Since, during its backward rotational movement, the lever element 25 passes out of engagement with the toothing 30 of the sleeve 31, the sleeve 31 and thus the wrap spring 33 can rotate backward independently of the lever element 25 and of the hand lever 20 until, and to such an extent that, the wrap spring 33 bears against the shell surface of the blocking roller 35 again and the frictional engagement between the blocking roller 35 and the wrap spring 33 has been fully established. In particular, possible limitations of the pivoting travels of the lever element 25 or of the hand lever 20 cannot prevent or impede a complete restoration of the frictional engagement. Since an elimination of the frictional engagement and the restoration of said frictional engagement is necessary during every production of a strap and, in the process, wear of the inner sides of the wrap spring 33 and/or of its contact partner, the blocking roller 35, occurs, it is in particular the case that a large number of produced straps can lead to abrasion of the wrap spring inner sides and/or of the blocking roller 35. This in turn has the result that the wrap spring end 33*a* must rotate backward further than before the onset of the wear in order to restore the intended frictional engagement of the wrap spring 33 with its at least one contact partner, in this case at least with the blocking roller 35. The wrap spring end 33*a* must thus possibly rotate beyond a previously assumed initial position, wherein said new position may, with progressive wear, move ever further away from the initial position without wear. This embodiment of the present disclosure thus includes compensation for progressive wear of the freewheel provided for the release of the tensioning wheel from the band, such as may arise owing to the repeated actuation of the wrap spring.

Figure 8:
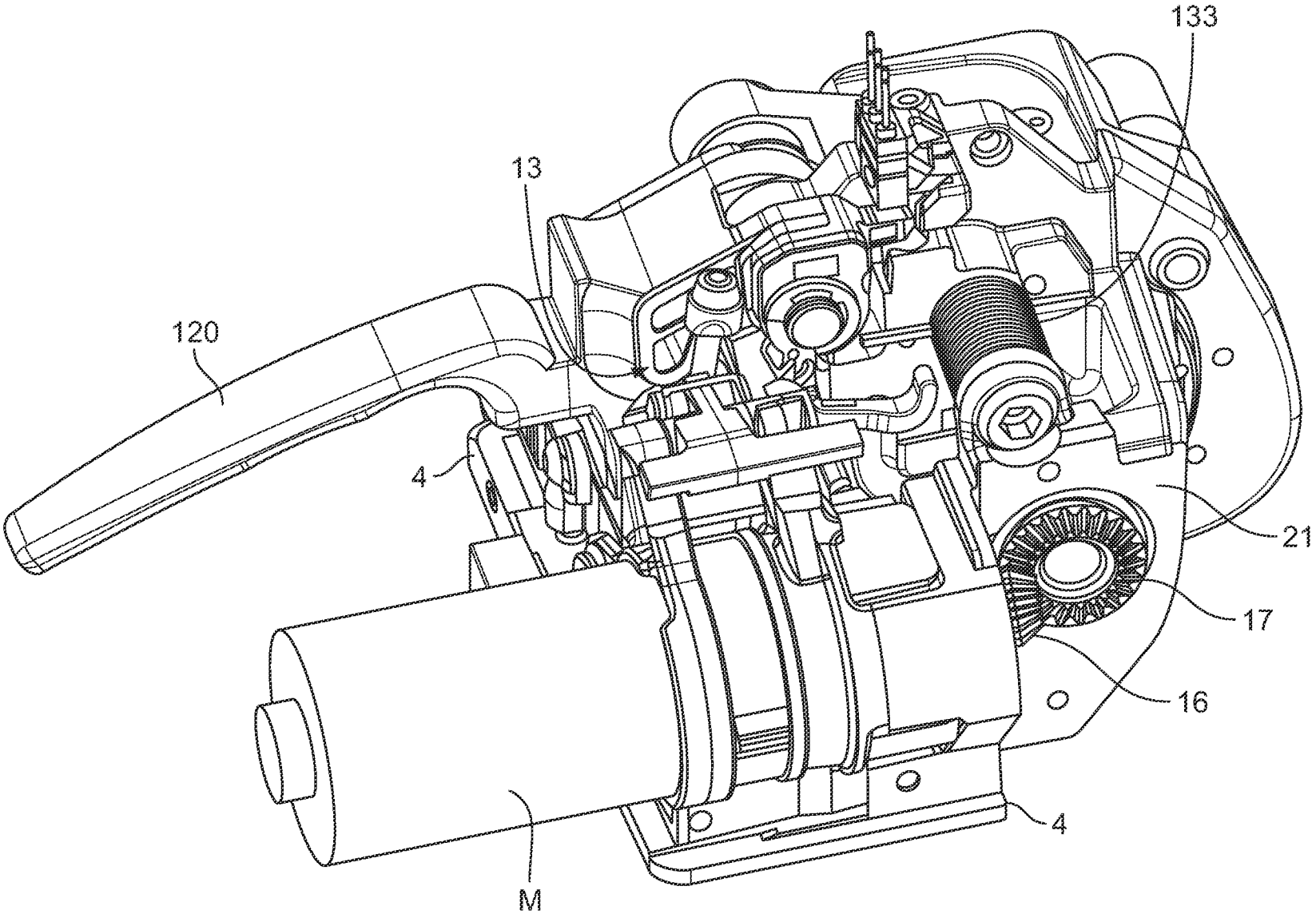
FIG. 8 shows a perspective illustration as per FIG. 2 of a second example embodiment of the present disclosure according to the present disclosure.
Figure 9:
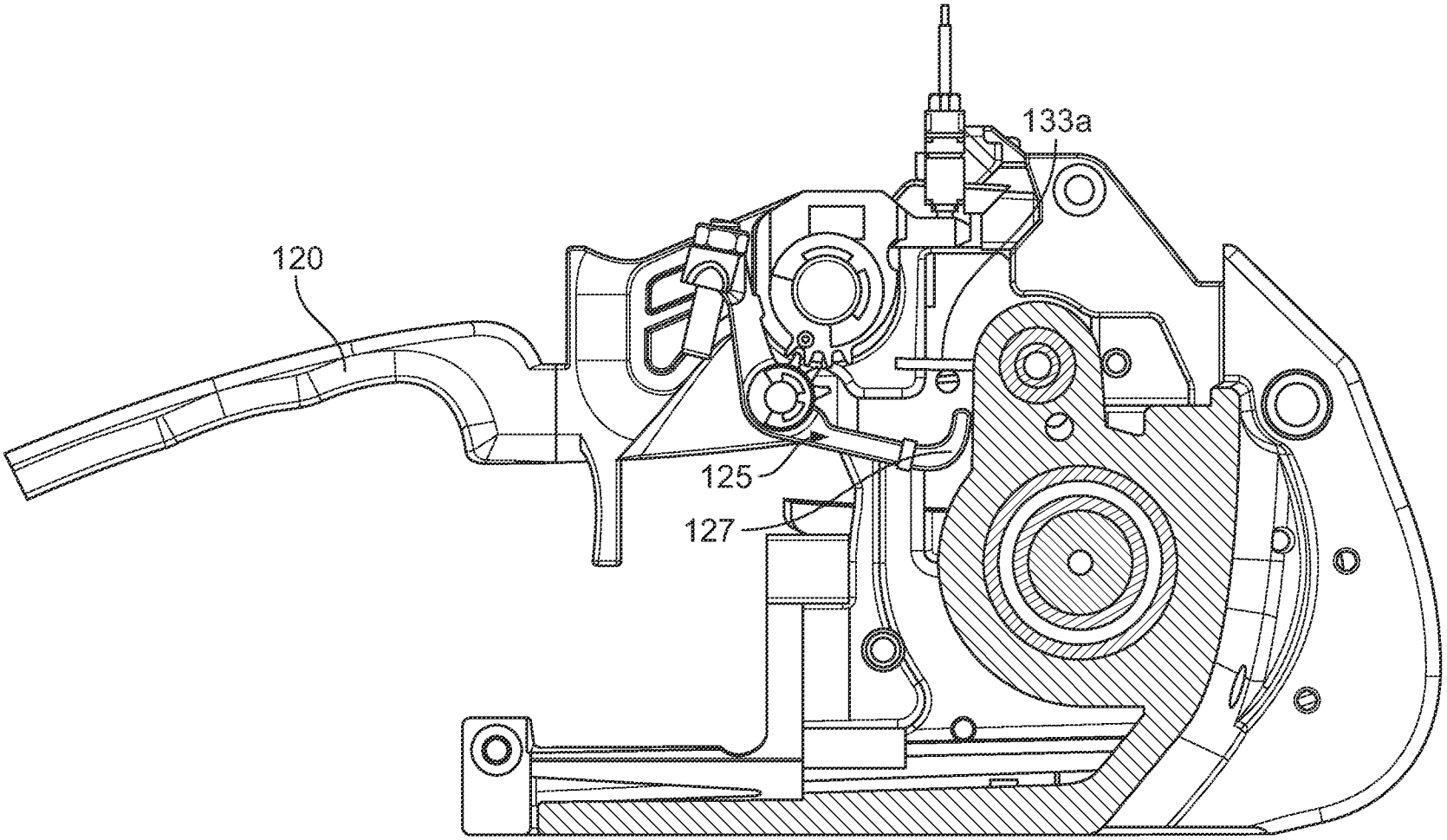
FIG. 9 shows a sectional illustration as per FIG. 3 of the second embodiment according to the present disclosure from FIG. 8, with an actuation mechanism assuming a first end position.
Figure 10:
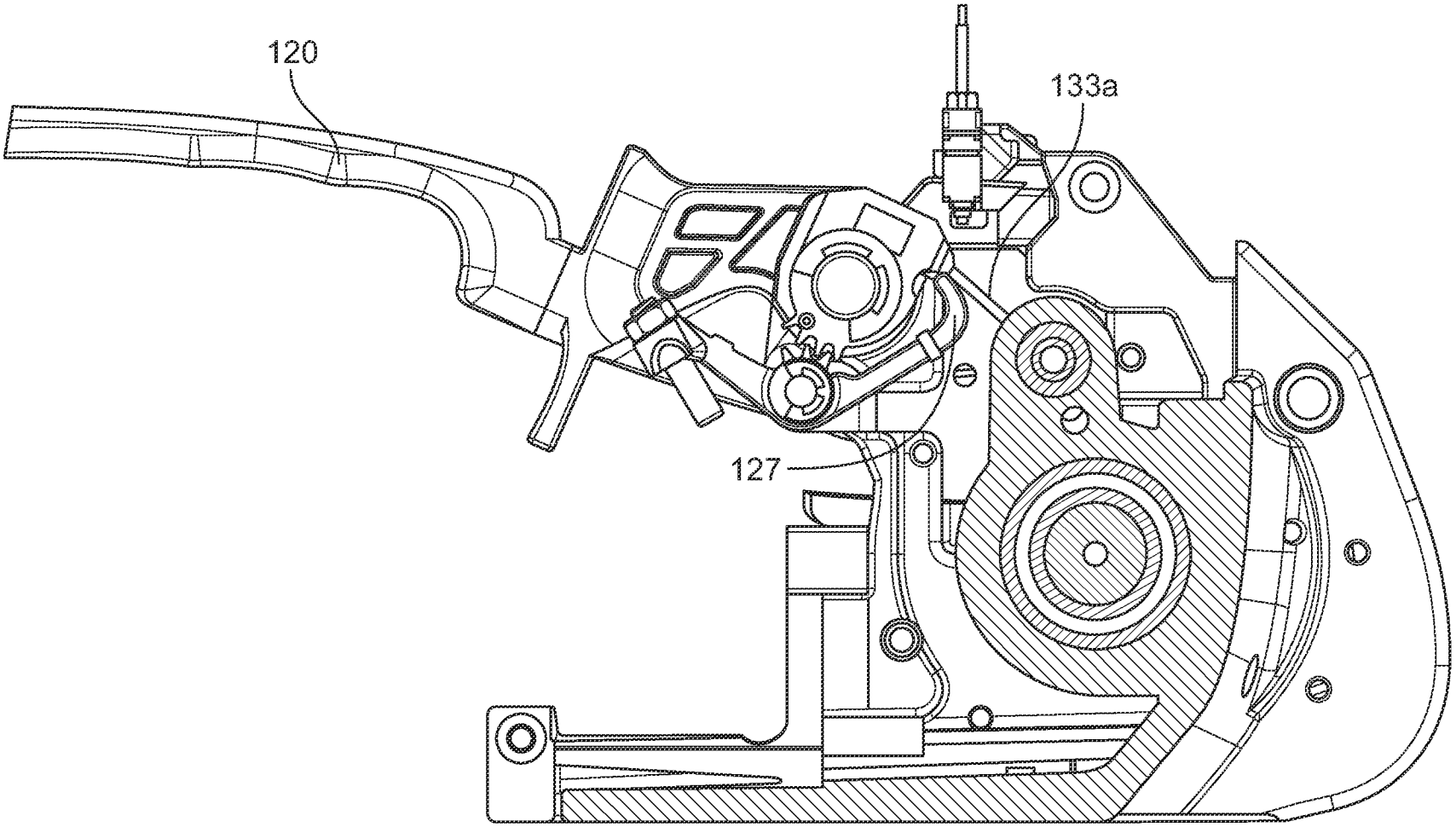
FIG. 10 shows an illustration as per FIG. 9 with an actuation mechanism in a second end position.
Figure 11:
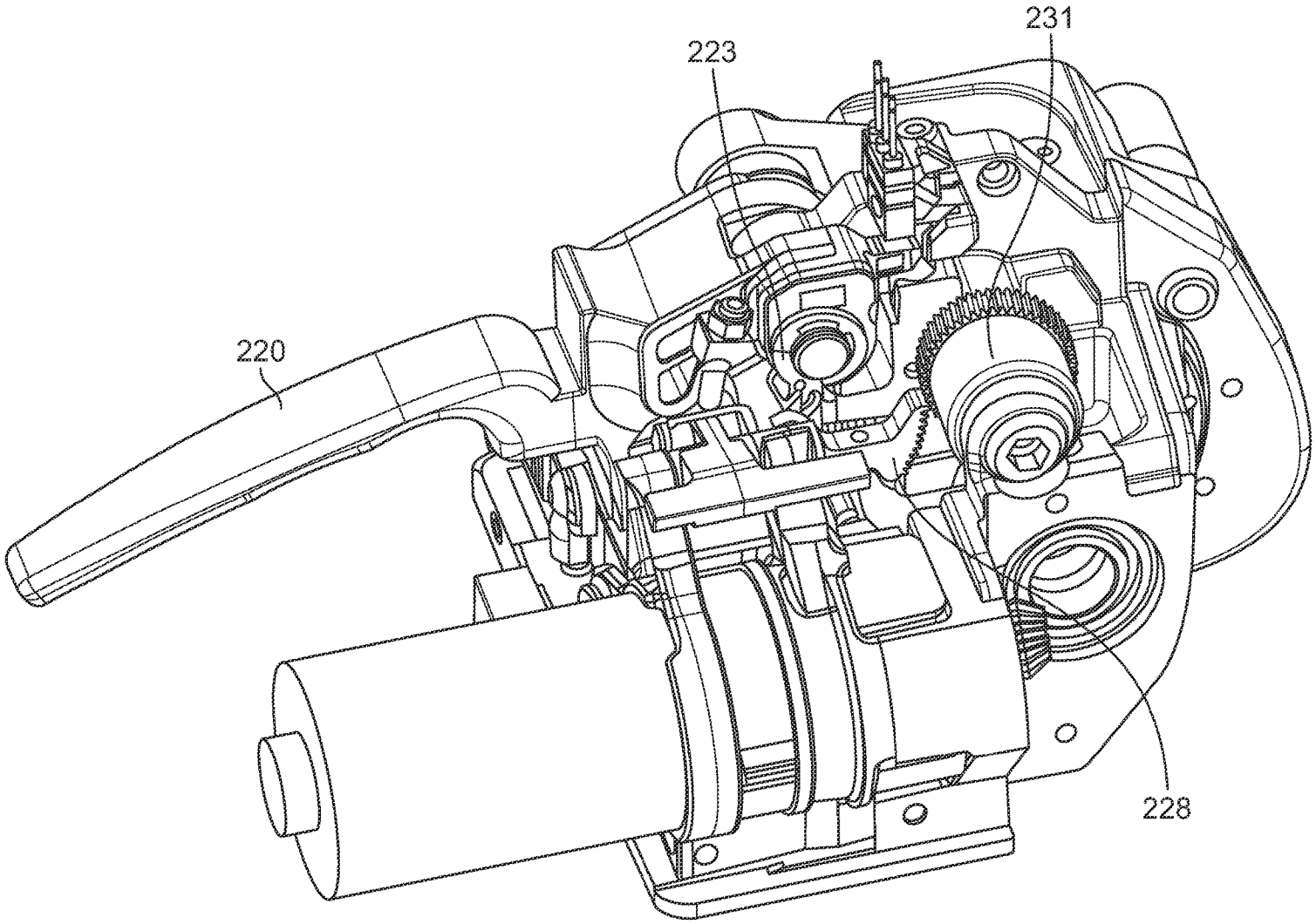
FIG. 11 shows a perspective partial illustration as per FIG. 2 of a further exemplary embodiment.
Figure 12:
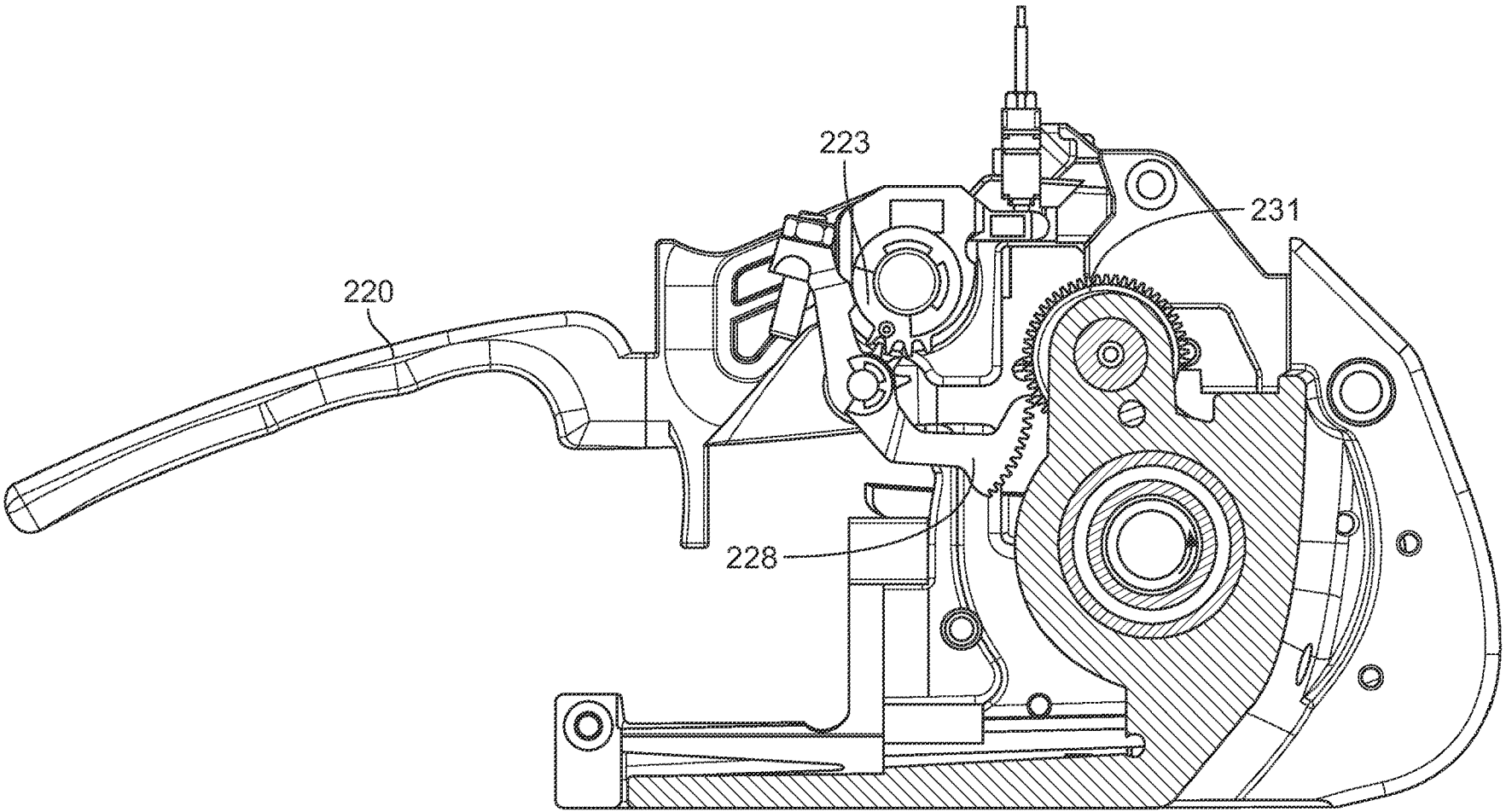
FIG. 12 shows a sectional illustration as per FIG. 3 of the further embodiment according to the present disclosure from FIG. 11, with an actuation mechanism assuming a first end position.
Figure 13:
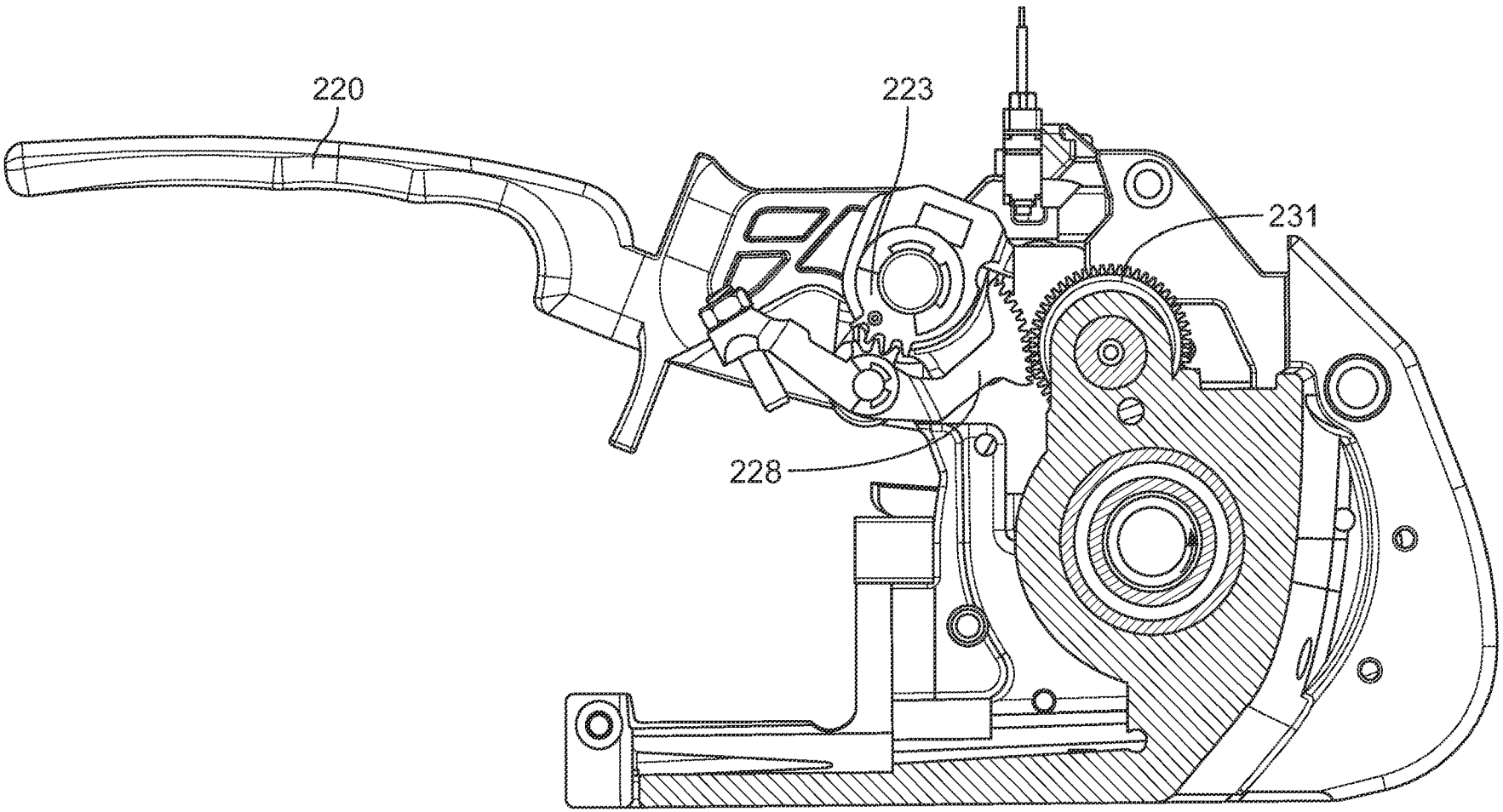
FIG. 13 shows an illustration as per FIG. 4 of the further embodiment according to the present disclosure from FIG. 11, with an actuation mechanism in a second end position.

FIGS. 8-10 illustrate a further exemplary embodiment of the present disclosure. This is in principle of the same construction as the exemplary embodiment discussed above, for which reason substantially only the differences will be discussed below. By contrast to the exemplary embodiment presented above, said further exemplary embodiment is however not equipped with the sleeve arranged on the wrap spring 133, and is not equipped with a circular-arc-shaped toothing element on the lever element 125. In this exemplary embodiment, the free end 127 of the lever element 125 acts directly on the free end 133*a* of the wrap spring 133. A pivoting movement of the hand lever 120 thus leads, via the engagement of toothings, to a rotational movement of the lever element 125 and of the free end 127 thereof. On its pivoting travel proceeding from the position shown in FIG. 9, the hook-shaped free end 127 of the lever element comes into contact with the end 133*a* of the wrap spring 133 and drives the latter along on its pivoting travel until the free end 127 of the lever arm has reached its second end position. The wrap spring end 133*a* hereby pivots substantially about the longitudinal axis of the wrap spring 133. Proceeding from the first winding, which adjoins the wrap spring end 133*a*, of the wrap spring 133, subsequent windings are thus successively also increased in diameter or size. In this way, the contact between the windings and the blocking roller (not shown) is reduced or eliminated at least to such an extent that the frictional engagement is eliminated and thus the blocking roller is rotatable about its longitudinal axis relative to the rotationally fixedly arranged wrap spring 133. In this exemplary embodiment, too, it is thus the case that the freewheel is switched by actuation of the wrap spring 133.

It is likewise provided that, during its backward rotational movement, the lever element 125 passes out of contact, and out of operative connection, with the free end 133*a* of the wrap spring 133 before the free end of the wrap spring 133 assumes its original initial position, in which the frictional engagement exists. Said restoring end positions of the wrap spring end and of the lever arm end 127 correspond to the positions of said elements shown in FIG. 9. Thus, it is also the case in this embodiment according to the present disclosure that the free end 133*a* of the wrap spring 133 can, owing to the spring restoring force, rotate backward unhindered and freely until the intended frictional engagement exists again between the wrap spring 133 and its contact partner.

FIGS. 11-14*c* illustrate a further preferred exemplary embodiment according to the present disclosure. The corresponding mobile strapping appliance is in principle of the same construction as the two exemplary embodiments of the present disclosure discussed above. Therefore, primarily the differences will be discussed below.

In this exemplary embodiment, too, a sleeve 231 is arranged on the wrap spring (not shown), which sleeve is equipped, on the circumference, with a toothing. A circular-arc-shaped toothing element 228, which is in principle of the same design as in the exemplary embodiment as per FIGS. 2-8, can be actuated by way of the hand lever 220 and the toothed segment 223. The circular-arc-shaped toothing element 228 is not in engagement with the toothing of the sleeve 231 when the hand lever 220 is in a non-actuated state, and enters into engagement with said toothing during the actuation. During a restoring movement of the hand lever 220, the toothing element 228 passes out of engagement with the toothing of the sleeve 231 again.

Figure 14B:
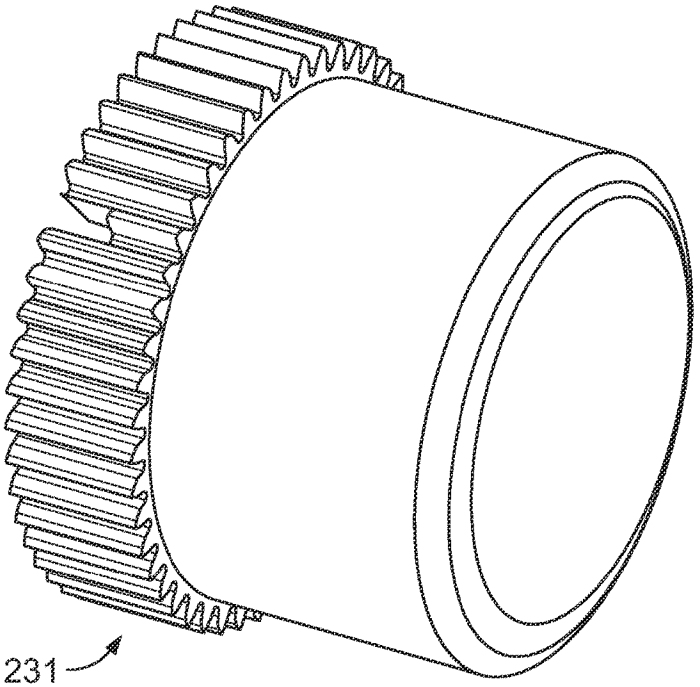
FIGS. 14*a*, 14*b*, and 14*c* show detailed illustrations of a sleeve for receiving a wrap spring, and the toothing of said sleeve, from the exemplary embodiment as per FIG. 11.
Figure 14C:
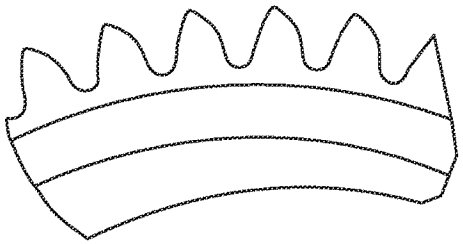
Figure 14A:
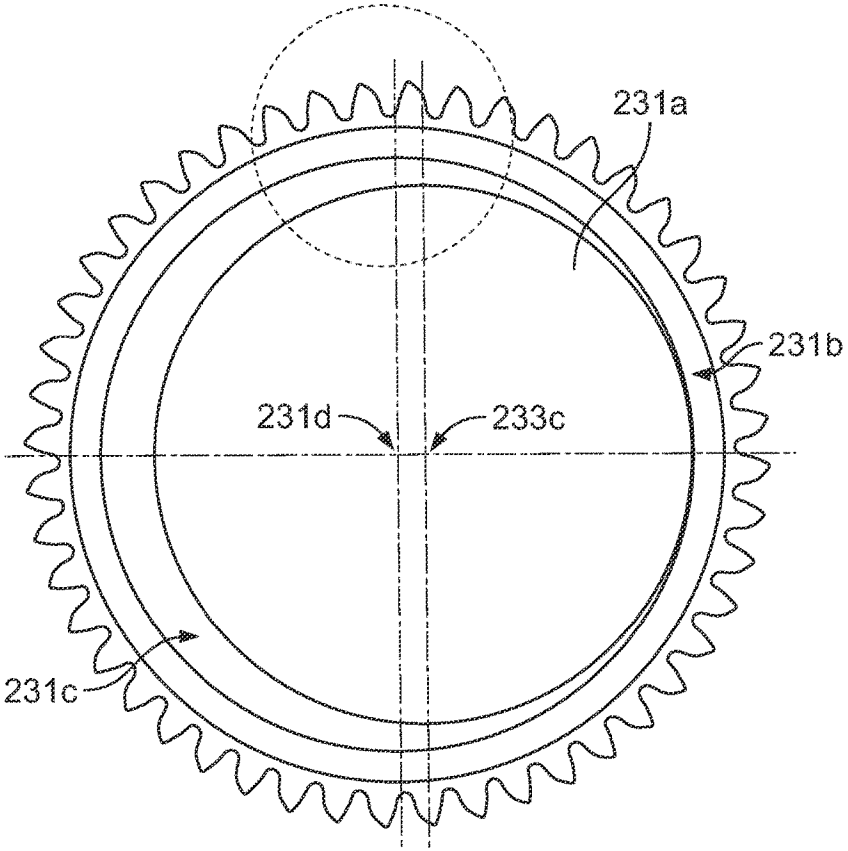
Figure 15:
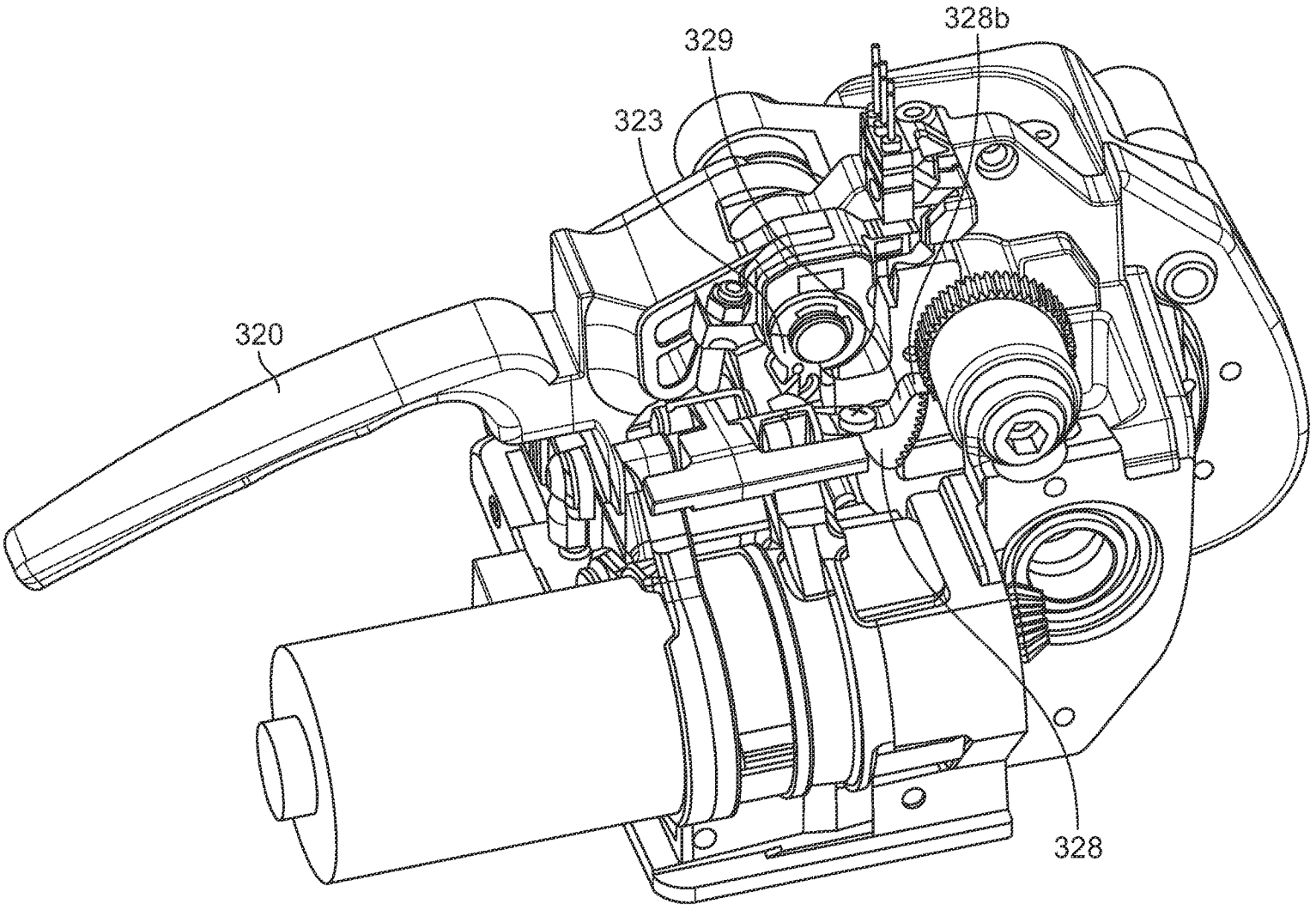
FIG. 15 shows a perspective partial illustration as per FIG. 2 of a further exemplary embodiment.
Figure 16:
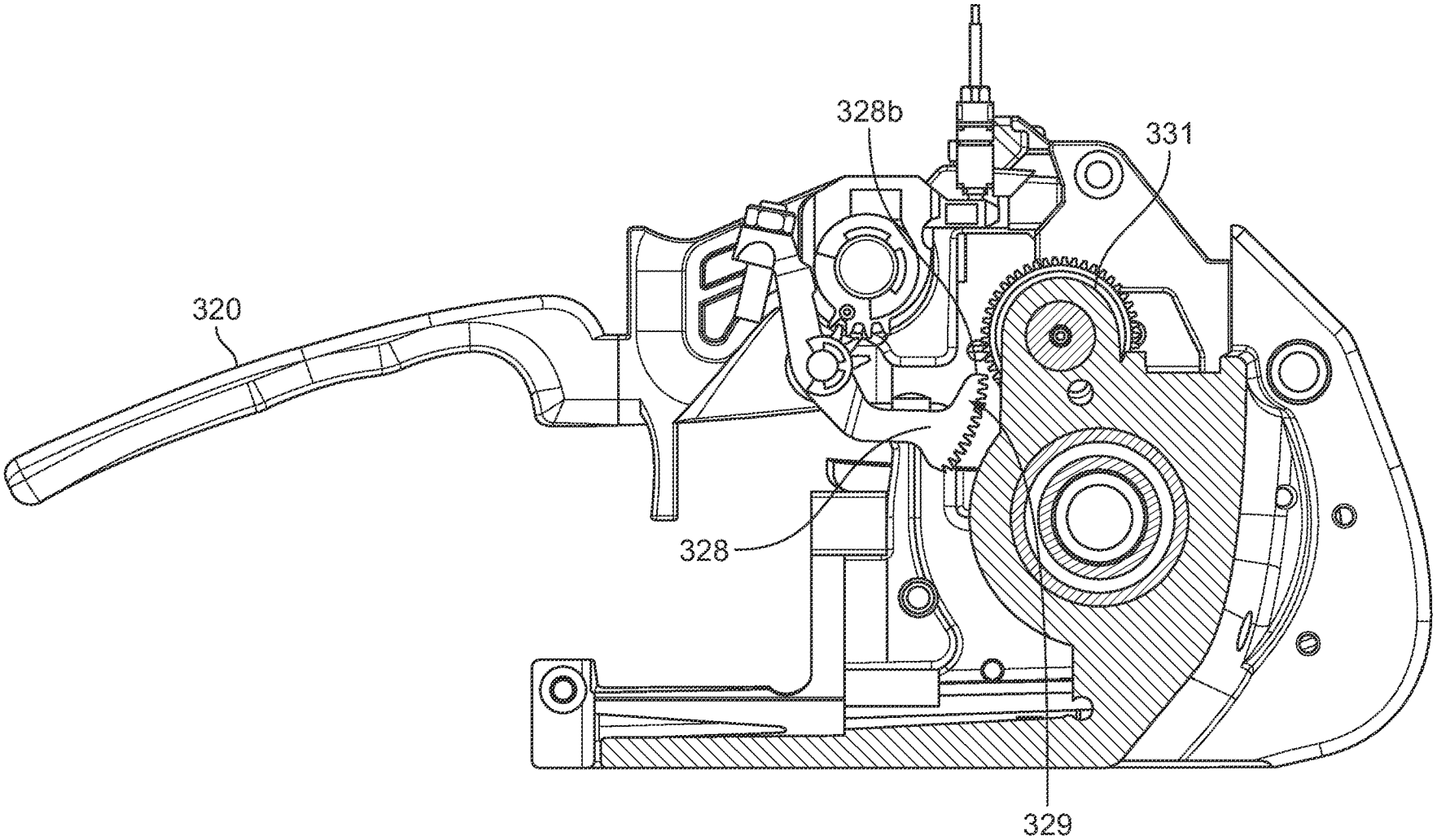
FIG. 16 shows a sectional illustration as per FIG. 3 of the further embodiment according to the present disclosure from FIG. 15, with an actuation mechanism assuming a first end position.

As can be seen in particular in FIGS. 14*a* and 14*b*, the sleeve 231 is equipped with a recess 231*a* which is arranged eccentrically with respect to the bearing axis, by way of which recess the sleeve 231 is pushed onto the wrap spring. The eccentricity is in this case arranged such that a cross-sectionally relatively thin region 231*b* of the sleeve 231 that arises from the eccentricity is arranged at least approximately on the side averted from the toothing element 228, and the cross-sectionally relatively thick region 231*c* is arranged on the side facing toward the toothing element 228.

As in the preferred exemplary embodiment discussed above as per FIGS. 2 to 8, it is also the case here that an asymmetrical toothing has been selected for the sleeve 231, by way of which the risk of a blockage of the two toothings owing to tooth tips striking one another is reduced. In other exemplary embodiments of the present disclosure, it is however also possible for conventional toothings, in particular involute toothings, to be provided.

In order, depending on the embodiment of the present disclosure, to remove either the band from the tensioning wheel or the tensioning wheel 7 from the band and the tensioning plate, the toothing element 228 is pivoted about its pivot axis by way of the hand lever 220, and thus the toothing element 228 is placed in engagement with the toothing of the sleeve 231. On the further pivoting travel, the two toothings mesh with one another, whereby the sleeve 231 is rotated and the wrap spring operatively connected to the sleeve is actuated. The internal diameter of the wrap spring is hereby increased in size, and the contact between the internal diameter of the wrap spring and the outer surface of the blocking roller 35 is eliminated, whereby the operative connection between the motor and the tensioning wheel is eliminated.

After a gap has thus been created between the tensioning wheel and the tensioning plate and the tension in the drive train of the tensioning wheel has been depleted in a non-abrupt manner, the band can be removed from the strapping appliance, and a new section of the strapping band can be inserted for a further strapping process. By way of a pivoting movement of the hand lever 220 in a now opposite direction, the gap between the tensioning wheel and the tensioning plate can be closed again, and the band can be clamped between said two elements in order to subsequently tension the band by way of a rotational movement of the tensioning wheel.

If, in this exemplary embodiment, the two first teeth of the toothing of the sleeve 231 and of the toothing of the toothing element 228 which have come into contact with one another strike one another by way of their tooth tips, there is the risk of blockage. In this exemplary embodiment, however, such a blockage can, with high probability, be avoided because the teeth that press against one another by way of their tip sections generate a force, the resultant direction of action of which is utilized to exert a torque. Said force runs along a straight line that intersects the central point of the toothing, that is to say the central point or the longitudinal axis 231*d* of the sleeve. Owing to the eccentrically arranged arrangement of the recess 231*a* or bore of the sleeve 231 and of the wrap spring arranged therein, and owing to the operative connection of the sleeve 231 to the wrap spring, said force gives rise to a torque about the central point or longitudinal axis 233*c* of the wrap spring. The lever arm of the torque is in this case the spacing between the longitudinal axis 233*c* of the wrap spring and the axis of the direction of action of the generated force. Said torque results in a slight rotation of the wrap spring about its longitudinal axis 233*c*, which wrap spring is supported at one side on a carrier part of the strapping apparatus and at the other side on the sleeve 231 and thus drives the latter along during its slight rotation. The resulting relative movement between the sleeve 231 and the toothing element 228 results in the toothing of the sleeve 231 rotating relative to the toothing of the toothing element 228, giving rise to a situation in which the two teeth that are in contact with one another no longer strike one another tip-to-tip. The first tooth of the toothing element 228 can now press against a flank of a tooth of the sleeve 231 and thus rotate the sleeve 231 as intended during the further movement of the toothing element 228. As in the exemplary embodiments discussed above, as a result of this, the frictional engagement of the wrap spring with the sleeve is eliminated with initial at least slight slippage, a backward rotation of the tensioning wheel is made possible, and thus the tension is released from the drive train of the tensioning wheel, and the bracing between tensioning wheel and the band is eliminated.

FIGS. 15 to 18 show a yet further preferred exemplary embodiment. The arrangement of the sleeve 331 and of the wrap spring corresponds here in principle to the exemplary embodiment as per FIGS. 2 to 8. The wrap spring is in this case arranged concentrically and non-eccentrically with respect to the longitudinal axis of the externally toothed rotatable sleeve 331. Furthermore, a pivotable toothing element 328 is also provided here, which is designed for engaging into the toothing of the sleeve 331.

In this preferred exemplary embodiment of the present disclosure according to the present disclosure, the first tooth 328*b*, provided for engaging into the toothing of the sleeve 331 during the pivoting movement, of the toothing of the toothing element 328 is of flexible form. Here, as first tooth 328*b*, a strip-like sheet-metal element 329 is provided, the shape of which is adapted to the top side of the toothing element. One end of the strip-like sheet-metal element 329 is in this case in the form of a tooth 328*b*, and is arranged so as to form a continuation of, or a beginning of, the toothing formed on the circular arc of the toothing element 328. By way of the adaptation of the sheet-metal element 329 to the face-side shape of the toothing element 328, said sheet-metal element is of doubly angled configuration. Both the tooth section of the sheet-metal element 329 and the first and second limbs 329*a*, 329*b*, which enclose an obtuse angle, bear in each case against a face-side top side of the toothing element 328. At its second limb 329*b*, the sheet-metal element 329 is fixed to the toothing element 328. In the exemplary embodiment, this is realized by way of a screw 345, though it would basically also be possible for any other fastening mechanism to be provided for this purpose. The strip-like sheet-metal element 329 with at least one tooth 328*b* of the toothing is thus fastened with a spacing to the intended contact point of the toothing element 328 with the toothing of the sleeve 331. Thus, owing to the resiliently elastic characteristics of the sheet-metal element 329 and the fastening thereof to the toothing element 328 with a spacing to the engagement or contact point of the fastening point, the at least one tooth 328*b* is deflectable relative to the toothing element 328.

As in the embodiments as per FIGS. 2-8, it is also the case here that, by way of a manually initiated pivoting movement of the hand lever 320 and the engagement of the toothed segment 323 into the toothing element 328, the toothing element is moved from a first end position, in which it is not in engagement with the toothing of the sleeve 331, into engagement with said toothing. Here, as long as the tooth tip of the first tooth 328*b* of the sheet-metal element strikes a tooth flank of the toothing of the sleeve 331, a conventional engagement of toothings occurs, as a result of which the sleeve 331 and the toothing thereof are driven along and rotated. By contrast, if, upon the initial contact of the toothing element 328, the first tooth 328*b* thereof, which is arranged on a separate component (sheet-metal element 329), strikes a tip of a tooth of the sleeve 331, the sheet-metal element 329 is deflected about its fastening point and is resiliently elastically tensioned in the process.

The spring force that acts on the sleeve 331 as a result can lead to a relative rotation of the sleeve 331 with respect to the toothing element 328, whereby subsequent teeth of the engagement partners each strike one another by way of their tooth flanks, and thus an engagement of the two toothings occurs as intended. It is likewise possible that, owing to the resiliently elastic deflection of the sheet-metal element 329 and the spring force that is generated as a result, the sheet-metal element 329 jumps over said tooth of the sleeve 331. In this way, too, a relative movement of the two toothings can occur and subsequent teeth of the engagement partners can engage into one another by way of the tooth flanks rather than the tooth tips. A further mechanism of action that prevents a blockage in conjunction with a first flexible tooth 328*b* and tip-to-tip striking of the first tooth 328*b* against a tooth of the sleeve toothing 331 may consist in that the tooth spacing of the first flexible tooth 328*b* with respect to the subsequent tooth and with respect to the further subsequent teeth of the toothing elements 328 varies. Owing to the flexibility of the first tooth 328*b*, the latter can be elastically deformed owing to the drive movement by the hand lever 320, wherein the toothing element 328, during the pivoting movement thereof, moves onward. In the case of this mechanism of action, the sleeve 331 does not yet move at this point in time. The first tooth 328*b* of the toothing element 328 can hereby be resiliently elastically tensioned, wherein the tip of the first tooth 328*b* initially remains positionally fixed, despite the fact that the toothing element 328 moves onward. In this way, the original spacing of the first tooth 328*b* to the subsequent tooth of the toothing element 328 temporarily changes. As a result of the relative movement of the toothing element with respect to the sleeve toothing, it is hereby the case that firstly the second tooth of the toothing element and then also the subsequent teeth each pass into a position relative to the sleeve toothing that is correct for engagement, and can thus engage into the sleeve toothing and thus begin to rotate the sleeve 331 and actuate the wrap spring.

In the case of each of the possible mechanisms of action, a blockage of the toothing element 328 with respect to the toothing of the sleeve 331 can be avoided, and the driving-along or rotation of the sleeve 331, and actuation of the wrap spring connected to and arranged in the sleeve 331, as intended according to the present disclosure can be realized.

Figure 17:
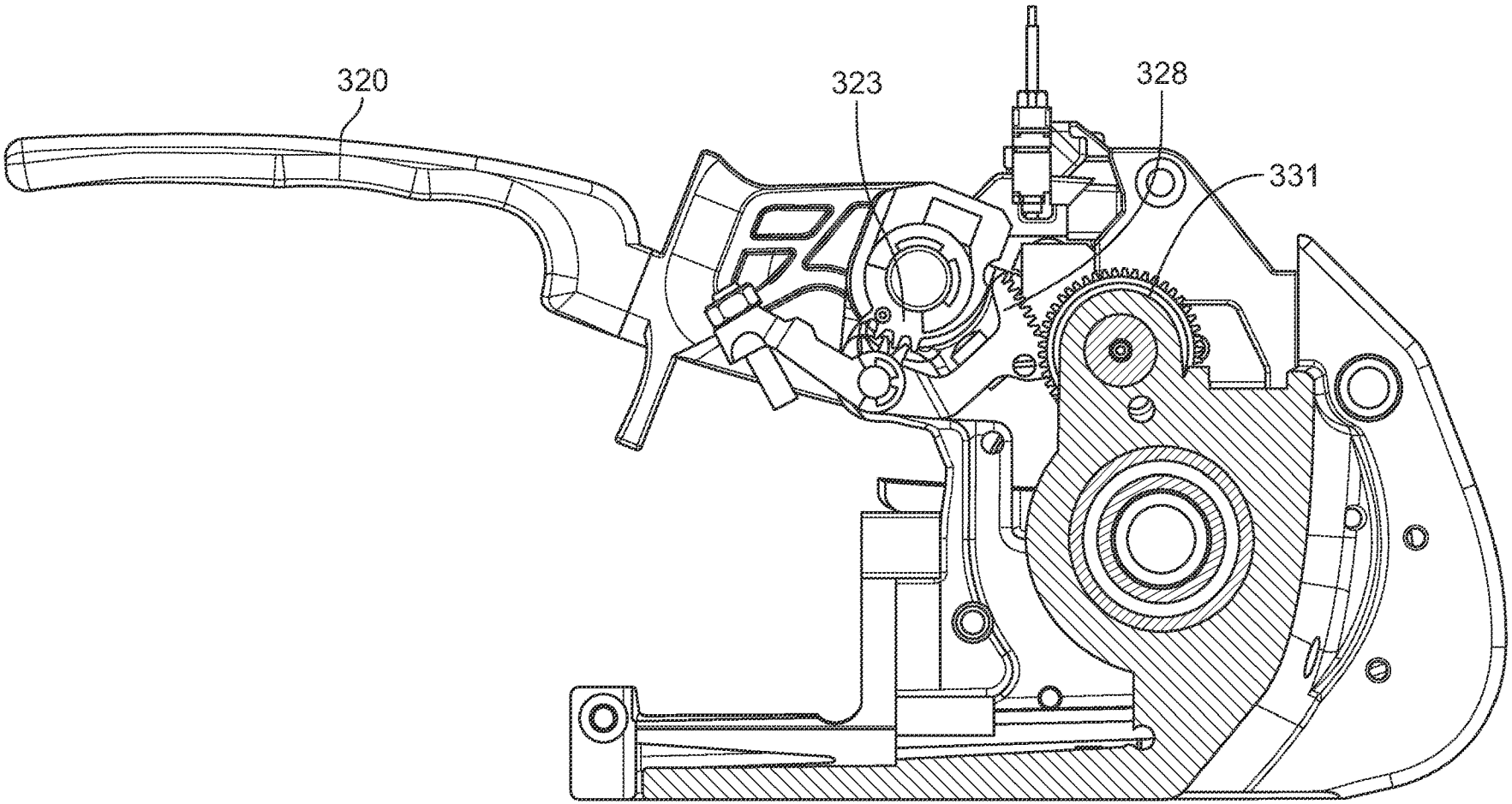
FIG. 17 shows an illustration as per FIG. 4 of the further embodiment according to the present disclosure from FIG. 15, with an actuation mechanism in a second end position.
Figure 18:
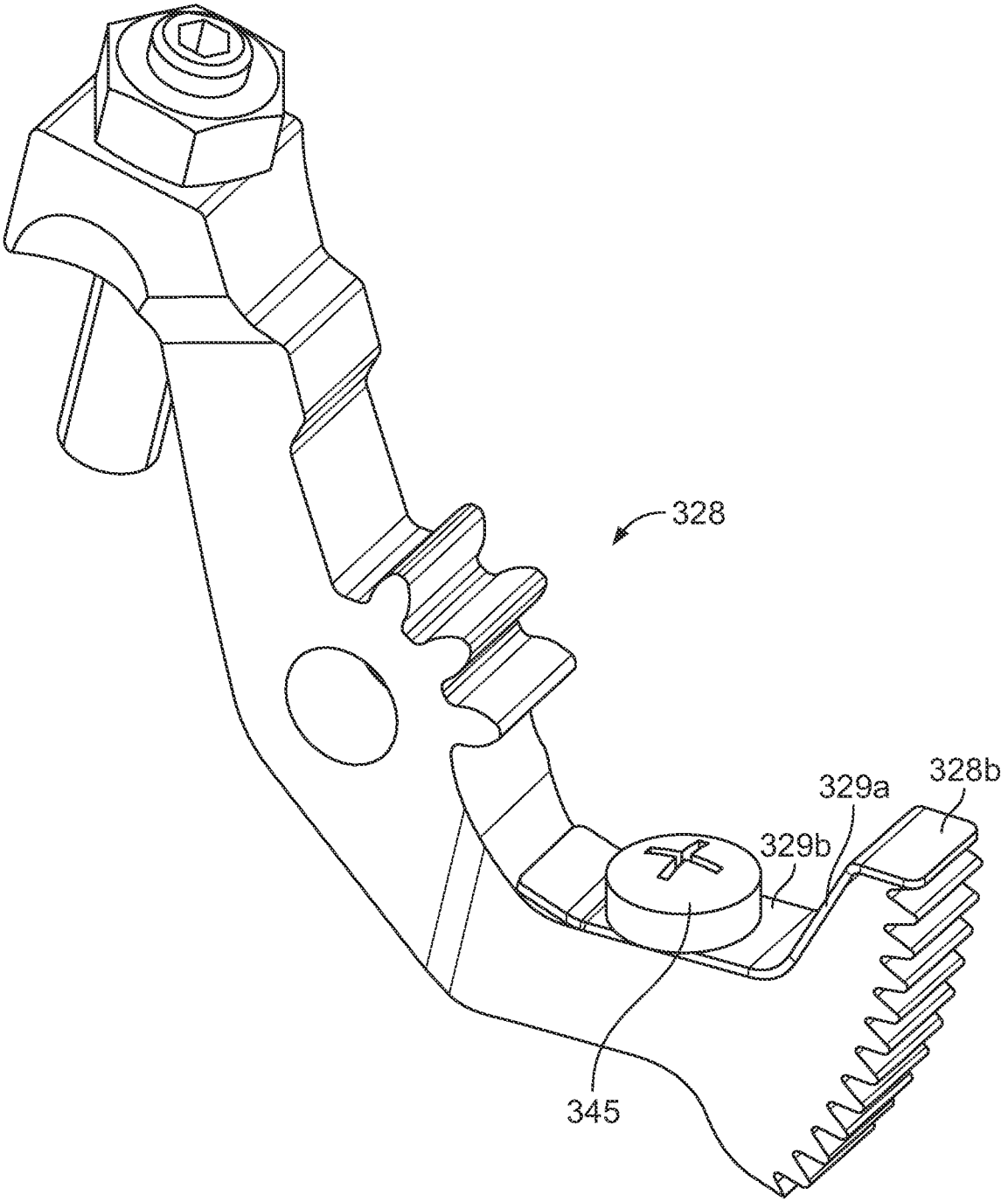
FIG. 18 shows a multi-part toothing element of the exemplary embodiment of FIGS. 15, 16, and 17 in a perspective illustration.
Figure 19:
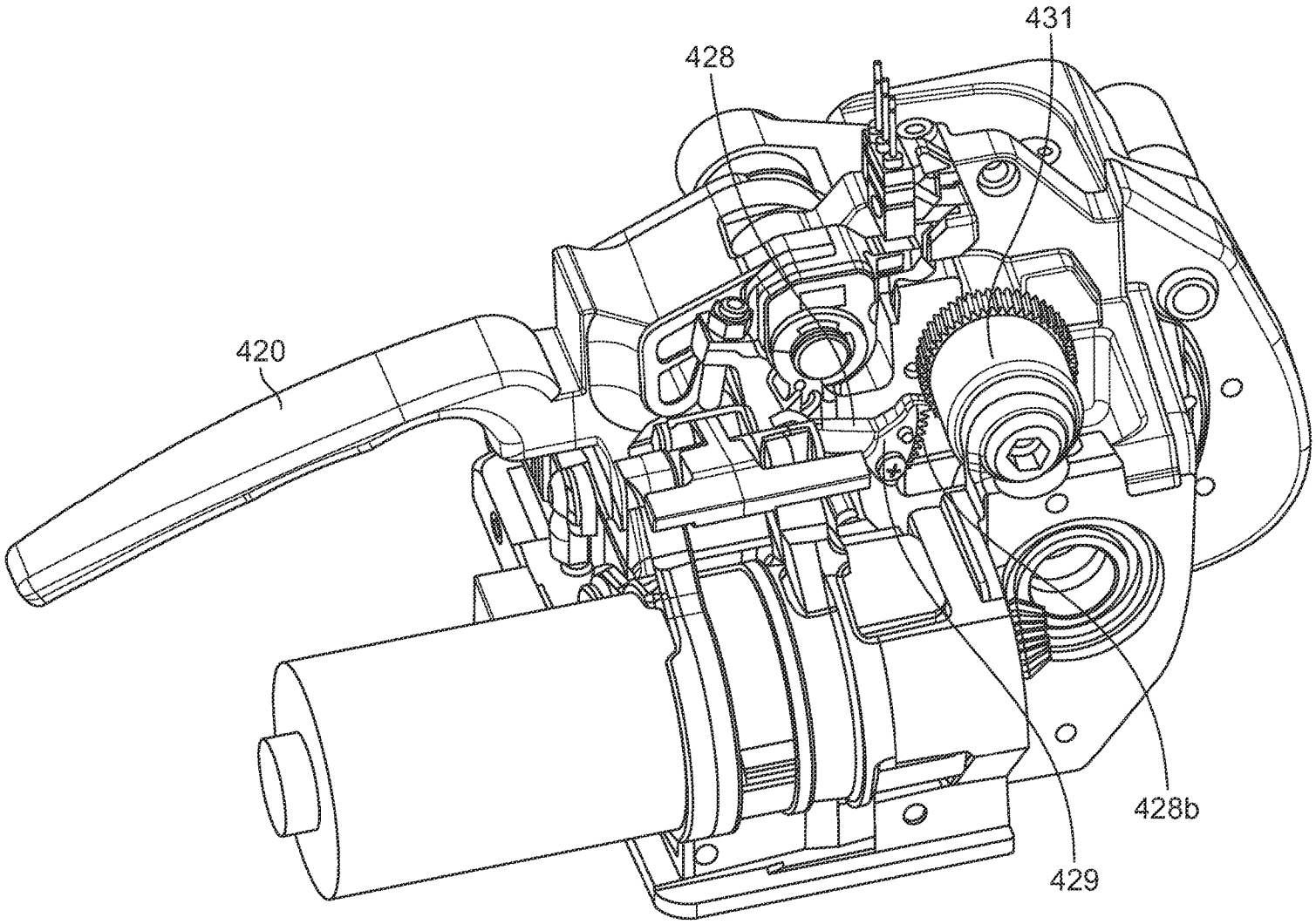
FIG. 19 shows a perspective partial illustration as per FIG. 2 of a further exemplary embodiment.

FIG. 17 shows the upper end position of the toothing element 328, in which it is still in engagement with the sleeve. The functional reliability of the wrap spring, and the release, realized by way thereof, of the tension or of the bracing in the drive train of the tensioning wheel can be enhanced by way of the resiliently elastically deflectable tooth of the toothing element 328.

FIGS. 19-22 illustrate a further preferred exemplary embodiment of the present disclosure. In this exemplary embodiment, too, a first tooth 428*b* of the pivotably mounted toothing element 428, which can be actuated by way of a hand lever 420, is provided, which first tooth is formed separately from the other teeth on a separate component 429. In this case, too, the first tooth 428*b* is formed on the separate component 429, which has a resiliently elastic material, such as for example spring steel. The separate component 429 of the two-part toothing element 428 may preferably in turn be manufactured from a metallic sheet. Said separate component is preferably arranged on and fastened to one side of the toothing element 428 such that, in a longitudinal direction of the toothing, the tooth 428*b* of the separate component is the first tooth that enters into engagement with the toothing of the sleeve 431. For this purpose, the toothing of the sleeve 431 preferably has a width which at least corresponds to the width made up of the width of the separate component 429 in the region of its tooth 428*b* and the toothing element in the region of its toothing. In the exemplary embodiment, the first tooth 428*b* is laterally offset in relation to the teeth of the toothing element 428, but is arranged with a spacing to the subsequent tooth in a longitudinal direction of the toothing which is equal to the spacing with which the teeth of the toothing as a whole follow one another in each case.

The component 429 of the first tooth 428*b* can be deflected laterally on the toothing element 428 about an axis of the fastening thereof, in this case of the screw 445. Said pivot axis runs at least substantially parallel to the axis of rotation of the toothing element 428. Furthermore, the separate component 429 has an elongate, lever-like rocker 429*a* which is arranged with a spacing to the tooth 428*b*. In the region of a free end of the rocker 429*a*, the latter is mounted in a resting manner on a counterbearing 446 of the toothing element 428 and is supported thereon. Furthermore, the separate component 429 is guided on the toothing element 428, such that, during a deflection owing to an action of force on the tooth 428*b*, a predetermined and reproducible deflection travel is realized.

Figure 20:
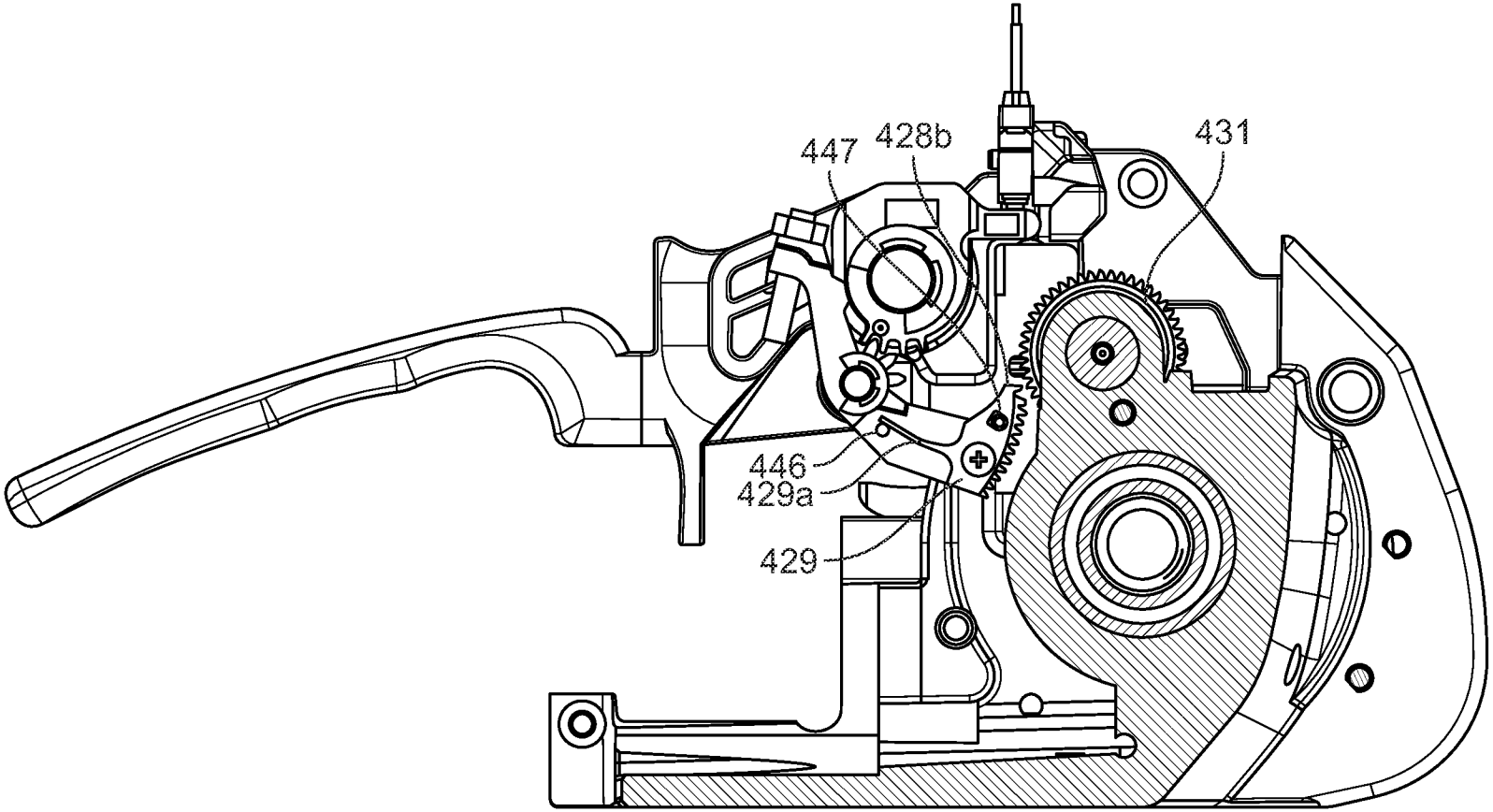
FIG. 20 shows a sectional illustration as per FIG. 3 of the further embodiment according to the present disclosure from FIG. 19, with an actuation mechanism assuming a first end position.

As in the other exemplary embodiments, during the tensioning process of the band, the toothing element 428 and its separate first tooth 428*b* is not in engagement with the toothing of the sleeve 431, as illustrated in FIG. 20. Only as a result of the actuation of the hand lever 420 is the toothing element 428 placed in contact, initially by way of its first tooth 428*b*, with the toothing of the sleeve 431. Here, if a flank of the first tooth 428*b* strikes a tooth flank of the toothing of the sleeve 431, the engagement of the two toothings occurs as intended. The subsequent teeth in the direction of rotation of the two toothings also engage in each case with a tooth flank against a tooth flank of the contact partner of the respective toothing, whereby the toothing element 428 rotates the sleeve 431 and thus actuates the wrap spring.

However, if the first tooth 428*b*, by way of its tooth tip, strikes a tooth tip of the toothing of the sleeve 431, then there is the risk of the two toothings becoming blocked and no longer being able to move. To avoid this risk, the first tooth 428*b* of the toothing element is movable. In this exemplary embodiment, the mobility is realized in the form of a resiliently elastic deflection, in the case of which the first tooth 428*b* can be elastically deflected by a tooth of the sleeve 431. That tooth of the sleeve toothing 431 which presses against the tooth tip of the first tooth deflects the first tooth around the fastening point, in this case the screw 445. By way of a guide 447, in this case a slot with a pin guided therein, a reproducible and always constant deflection travel is realized here. As a result of said deflection, the lever-like rocker 429*a* bears against the pin-like counterbearing 446 of the toothing element 428. As a result, a restoring moment and a restoring force are generated with which the first tooth 428*b* presses against the tooth of the sleeve 431. Since said restoring force which acts on the sleeve 431 at the tooth tip of the first tooth 428*b* has a direction of action that does not intersect the axis of rotation 431*a* of the sleeve 431 and thus also does not intersect the longitudinal axis of the wrap spring, said restoring force imparts a torque about the sleeve 431. Said torque leads to an at least slight rotation of the sleeve 431 about its longitudinal axis 431*a*. Owing to said rotation, the first tooth is subsequently no longer in contact with the tooth tip of the corresponding tooth of the sleeve toothing 431, and now engages between two successive teeth of the sleeve toothing 431. As in the previous exemplary embodiment, it is also possible here for the elastic deformation of the first tooth 428*b* to lead to a temporary change in the tooth spacing of the first tooth with respect to the tooth following it, which effects an elimination of the blockage.

Figure 21:
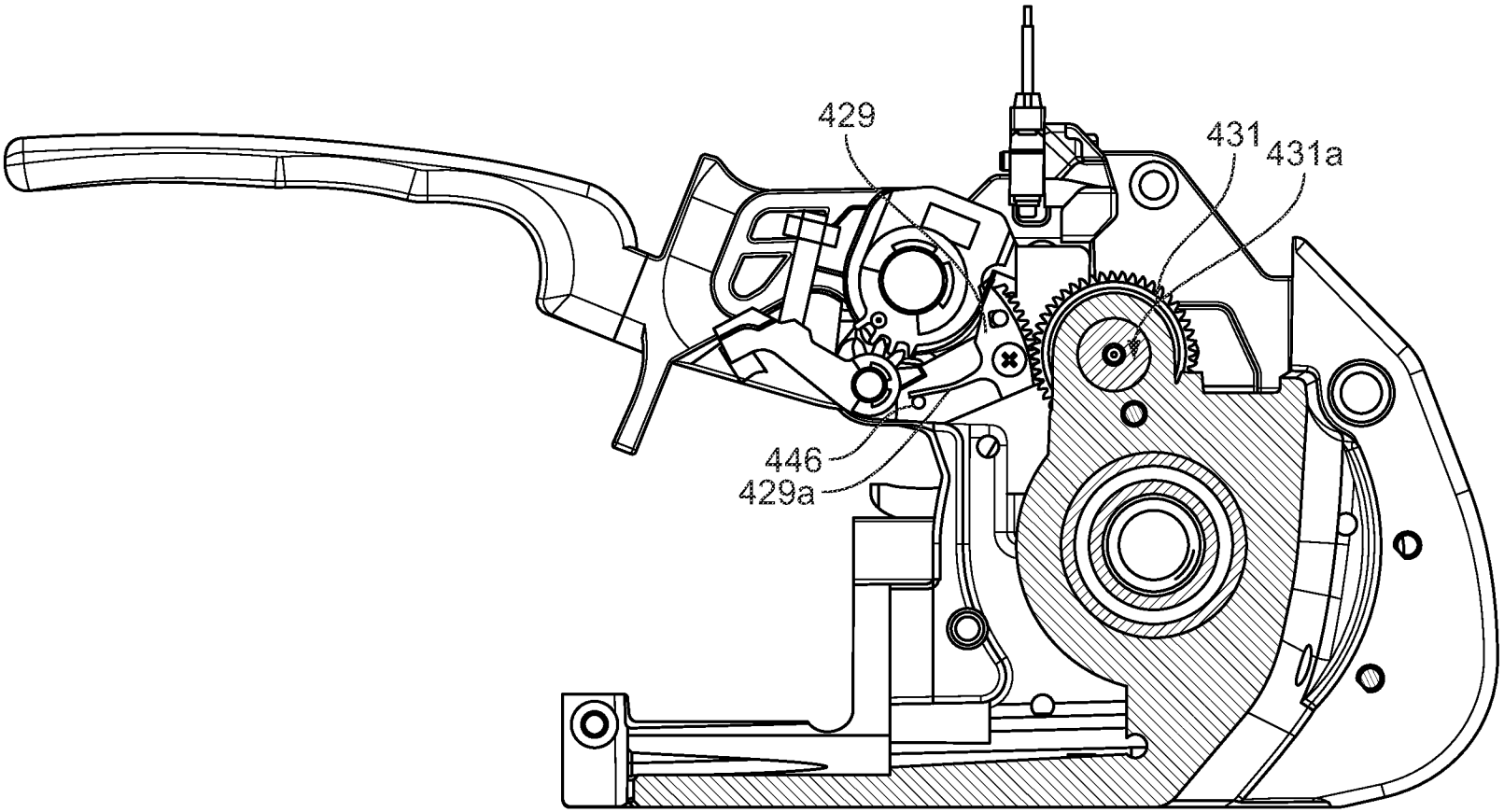
FIG. 21 shows an illustration as per FIG. 4 of the further embodiment according to the present disclosure from FIG. 19, with an actuation mechanism in a second end position.
Figure 22:
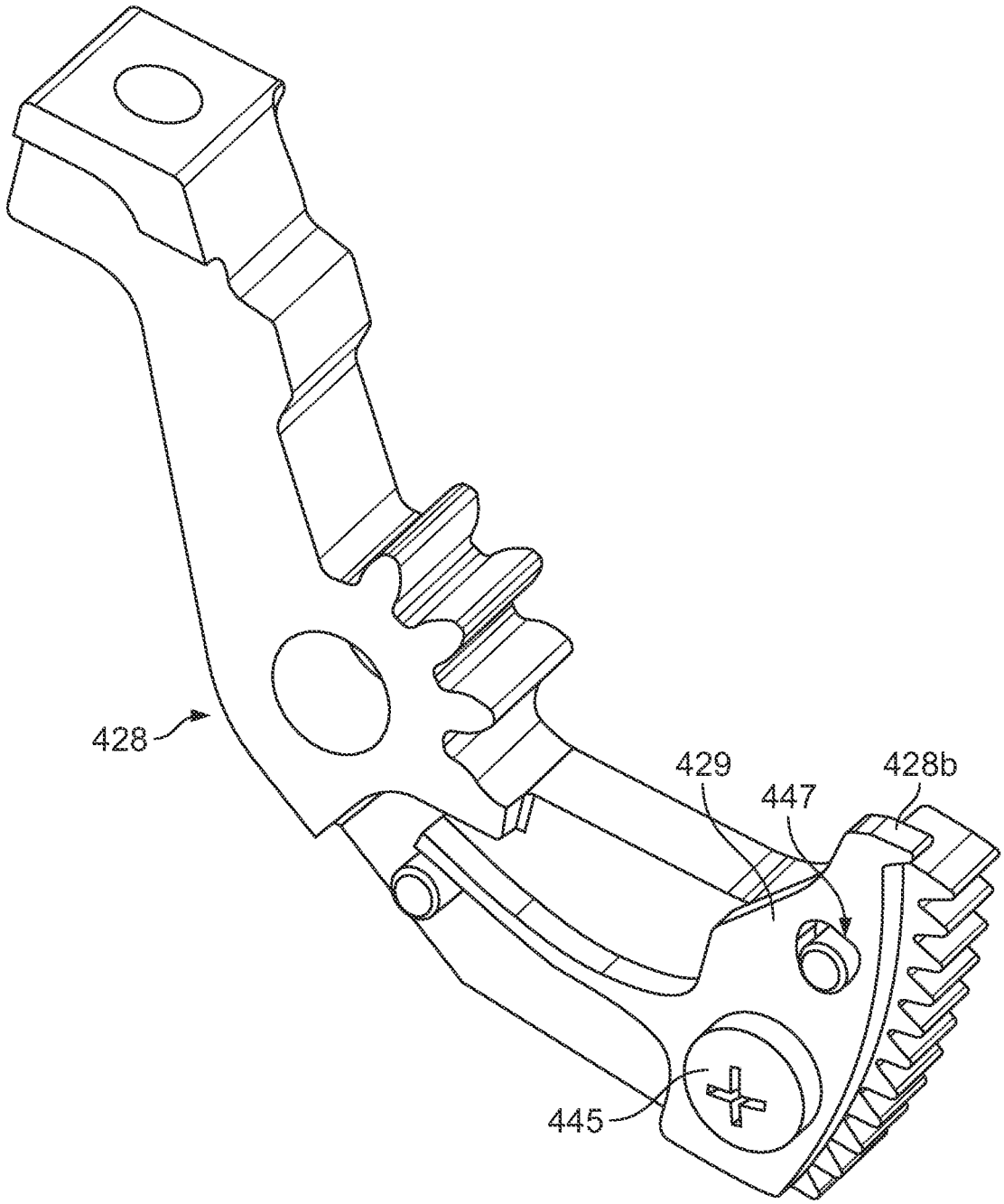
FIG. 22 shows a multi-part toothing element of the exemplary embodiment of FIGS. 19, 20, and 21 in a perspective illustration.

In this way, the first tooth 428*b* can transmit the pivoting movement, introduced by the hand lever 420, of the toothing element 428 to the sleeve toothing, whereby subsequent teeth of the two toothings also engage into one another and continue the rotational movement of the sleeve 431 until an upper end position of the toothing element 428 is reached, as illustrated in FIG. 21. In this end position, the toothing element 428 is still in engagement with the sleeve toothing. The band of a finished strap can now be removed, and a new band section can be inserted into the strapping appliance for the production of a further strap. Here, too, as in the exemplary embodiments discussed above, the wrap spring can subsequently be relieved of tension again by way of a return movement of the toothing element 428 from its upper end position in FIG. 21 into the lower end position shown in FIG. 20 by way of a backward rotation of the sleeve 431. As a result, the wrap spring bears with its internal diameter against the outer surface of the blocking roller 35 again, and thereby produces the operative connection between the motor drive and the tensioning wheel. The tensioning wheel can hereby be supported on the frame of the strapping apparatus again for the purposes of absorbing torque. A subsequent tensioning and strapping process can thus be performed.

What is claimed is:

1. A strapping device comprising:

a base plate;

a tensioning plate on the base plate;

a rocker pivotable about a rocker axis from a first rocker position to a second rocker position;

a tensioning wheel pivotable with the rocker such that movement of the rocker from the first rocker position to the second rocker position moves the tensioning wheel away from the tensioning plate and movement of the rocker from the second rocker position to the first rocker position moves the tensioning wheel toward the tensioning plate, wherein the tensioning wheel is rotatable about a tensioning-wheel axis in a tensioning direction and in a reverse direction opposite the tensioning direction;

a blocking element indirectly connected to the tensioning wheel and rotatable about a blocking-element axis in a first rotational direction;

a shaft having a shaft axis;

a lever movable between a first lever position and a second lever position, wherein when the lever is in the first lever position, the blocking element is prevented from rotating in the first rotational direction such that, after the tensioning wheel tensions strap around an object, the blocking element prevents the tensioning wheel from rotating in the reverse direction, wherein when the lever is in the second lever position, the blocking element is rotatable in the first rotational direction to enable the tensioning wheel to rotate in the reverse direction; and a rotatable element rotatable about the shaft axis and configured to force the lever to move from the first lever position to the second lever position as the rotatable element rotates about the shaft axis.

2. The strapping device of claim 1, wherein the rotatable element comprises an engaging element extending radially outwardly from the shaft axis.

3. The strapping device of claim 2, wherein the engaging element is configured to force the lever to move from the first lever position to the second lever position as the rotatable element rotates about the shaft axis.

4. The strapping device of claim 3, wherein the lever is pivotable about a lever axis between the first lever position and the second lever position.

5. The strapping device of claim 4, wherein the shaft axis and the lever axis are not coaxial.

6. The strapping device of claim 5, wherein the rotatable element is connected rotationally conjointly to the shaft.

7. The strapping device of claim 5, wherein the lever axis is closer to the base plate than the shaft axis.

8. The strapping device of claim 7, wherein the lever axis and the shaft axis are parallel.

9. The strapping device of claim 8, wherein none of the lever axis, the shaft axis, and the blocking-element axis are coaxial and all of the lever axis, the shaft axis, and the blocking-element axis are parallel.

10. The strapping device of claim 1, wherein the rotatable element is connected rotationally conjointly to the shaft.

11. The strapping device of claim 10, wherein the rotatable element comprises an engaging element extending radially outwardly from the shaft axis and configured to force the lever to move from the first lever position to the second lever position as the rotatable element rotates about the shaft axis.

12. The strapping device of claim 11, wherein the rotatable element comprises a gear element and the engaging element comprises one or more teeth.

13. The strapping device of claim 12, wherein the lever comprises one or more teeth meshed with the one or more teeth of the gear element, wherein the lever is pivotable about a lever axis between the first lever position and the second lever position.

14. The strapping device of claim 13, further comprising a wrap spring having a first end, a second end, and a wrap-spring axis, wherein movement of the lever from the first lever position to the second lever position causes the first end of the wrap spring to rotate about the wrap-spring axis, wherein the wrap spring frictionally engages the blocking element when the lever is in the first lever position to prevent the blocking element from rotating in the first rotational direction such that, after the tensioning wheel tensions the strap around the object, the blocking element prevents the tensioning wheel from rotating in the reverse direction, wherein the frictional engagement between the wrap spring and the blocking element is at least partially eliminated when the lever moves from the first lever position to the second lever position such that the blocking element is rotatable in the first rotational direction to enable the tensioning wheel to rotate in the reverse direction.

15. The strapping device of claim 14, wherein the second end of the wrap spring is fixed in rotation about the wrap-spring axis, wherein the wrap spring comprises multiple windings, wherein the rotation of the first end of the wrap spring about the wrap-spring axis as the lever moves from the first lever position to the second lever position gradually widens respective diameters of successive windings of the wrap spring.

16. The strapping device of claim 15, further comprising a rotatable sleeve comprising external toothing, wherein the first end of the wrap spring is fixed in rotation with the sleeve, wherein the lever comprises an arm comprising multiple teeth, wherein movement of the lever from the first lever position to the second lever position causes the teeth of the arm to drivingly engage the external toothing of the sleeve and thereby cause the sleeve to rotate.

17. The strapping device of claim 1, further comprising a motor configured to move the rocker from the first rocker position to the second rocker position and to rotate the rotatable element to cause the lever to move from the first lever position to the second lever position.

18. The strapping device of claim 17, wherein the motor is configured to rotate the rotatable element to cause the lever to move from the first lever position to the second lever position before moving the rocker from the first rocker position to the second rocker position.

19. The strapping device of claim 17, wherein the motor is further configured to rotate the tensioning wheel in the tensioning direction.

20. The strapping device of claim 17, wherein the rotatable element is connected rotationally conjointly to the shaft.

21. The strapping device of claim 20, wherein the rotatable element comprises an engaging element extending radially outwardly from the shaft axis and configured to force the lever to move from the first lever position to the second lever position as the rotatable element rotates about the shaft axis.

22. The strapping device of claim 17, wherein the lever is pivotable about a lever axis between the first lever position and the second lever position.

23. The strapping device of claim 22, wherein the shaft axis and the lever axis are not coaxial.

24. The strapping device of claim 23, wherein the rotatable element is connected rotationally conjointly to the shaft.

25. The strapping device of claim 24, wherein the lever axis is closer to the base plate than the shaft axis.

26. The strapping device of claim 25, wherein the lever axis and the shaft axis are parallel.

27. The strapping device of claim 25, wherein the motor is configured to rotate the rotatable element to cause the lever to move from the first lever position to the second lever position before moving the rocker from the first rocker position to the second rocker position.

28. The strapping device of claim 1, further comprising a hand lever operably connected to the rocker and the rotatable element and movable from a first hand-lever position to a second hand-lever position to move the rocker form the first rocker position to the second rocker position and to rotate the rotatable element to cause the lever to move from the first lever position to the second lever position.

29. The strapping device of claim 28, wherein the hand lever is operably connected to the rocker and the rotatable element such that movement of the hand lever from the first hand-lever position to the second hand-lever position causes the rotatable element to rotate to cause the lever to move from the first lever position to the second lever position before causing the rocker to move from the first rocker position to the second rocker position.

* * * * *